US009703215B2

(12) United States Patent
Suzuki et al.

(10) Patent No.: US 9,703,215 B2
(45) Date of Patent: Jul. 11, 2017

(54) ELECTROPHOTOGRAPHIC PHOTORECEPTOR, METHOD OF PRODUCING SAME, AND ELECTROPHOTOGRAPHIC APPARATUS

(71) Applicant: FUJI ELECTRIC CO., LTD., Kawasaki-shi (JP)

(72) Inventors: Shinjiro Suzuki, Matsumoto (JP); Tomoki Hasegawa, Hino (JP); Fengqiang Zhu, Matsumoto (JP)

(73) Assignee: FUJI ELECTRIC CO., LTD., Kawasaki-Shi (JP)

( * ) Notice: Subject to any disclaimer, the term of this patent is extended or adjusted under 35 U.S.C. 154(b) by 0 days.

(21) Appl. No.: 15/042,131

(22) Filed: Feb. 11, 2016

(65) Prior Publication Data

US 2016/0161870 A1 Jun. 9, 2016

Related U.S. Application Data

(63) Continuation of application No. PCT/JP2013/085250, filed on Dec. 27, 2013.

(51) Int. Cl.

| | |
|---|---|
| ***G03G 5/00*** | (2006.01) |
| ***G03G 5/05*** | (2006.01) |
| ***G03G 5/047*** | (2006.01) |

(52) U.S. Cl.

CPC ..... *G03G 5/0567* (2013.01); *G03G 5/047* (2013.01); *G03G 5/056* (2013.01); *G03G 5/0525* (2013.01); *G03G 5/0564* (2013.01); *G03G 5/0596* (2013.01)

(58) Field of Classification Search

CPC ... G03G 5/0564; G03G 5/0567; G03G 5/0596

USPC ..... 430/96

See application file for complete search history.

(56) References Cited

U.S. PATENT DOCUMENTS

| | | | |
|---|---|---|---|
| 5,798,197 | A | 8/1998 | Paulus et al. |
| 8,404,414 | B2 | 3/2013 | Takaki et al. |
| 9,442,400 | B2 | 9/2016 | Zhu et al. |
| 2005/0079431 | A1 | 4/2005 | Kobashi et al. |

FOREIGN PATENT DOCUMENTS

| | | | |
|---|---|---|---|
| JP | S61-62040 | A | 3/1986 |
| JP | 01-205171 | A | 8/1989 |
| JP | H03-6567 | A | 1/1991 |
| JP | 07-333881 | A | 12/1995 |
| JP | H10-504311 | A | 4/1998 |
| JP | 2000-292956 | A | 10/2000 |
| JP | 2001-201880 | A | 7/2001 |
| JP | 2002-128883 | A | 5/2002 |

(Continued)

*Primary Examiner* — Mark A Chapman

(74) *Attorney, Agent, or Firm* — Rabin & Berdo, P.C.

(57) ABSTRACT

An electrophotographic photoreceptor is provided that can achieve reductions in the amount of wear in the photoreceptor surface while producing an excellent image on a long-term basis. Also provided are a method of producing the electrophotographic photoreceptor and an electrophotographic apparatus. The electrophotographic photoreceptor includes a conductive substrate; and a photosensitive layer provided on the conductive substrate and being composed of a resin having a molecular structure optimized using molecular dynamic calculations that is a helical structure, and having a value for a ratio r/I between the diameter (r) and helix pitch (I) of the helical structure that ranges from 0.04 to 1.0.

11 Claims, 3 Drawing Sheets

(56) References Cited

FOREIGN PATENT DOCUMENTS

| | | | |
|---|---|---|---|
| JP | 2002-214807 | A | 7/2002 |
| JP | 2002-251024 | A | 9/2002 |
| JP | 2003-082078 | A | 3/2003 |
| JP | 2004-093865 | A | 3/2004 |
| JP | 2005-115091 | A | 4/2005 |
| JP | 2005-173376 | A | 6/2005 |
| JP | 2007-093733 | A | 4/2007 |
| JP | 2007-121751 | A | 5/2007 |
| JP | 2009-271152 | A | 11/2009 |
| JP | 2010-096929 | A | 4/2010 |
| WO | WO 2013-128575 | A1 | 9/2013 |

ELECTROPHOTOGRAPHIC PHOTORECEPTOR, METHOD OF PRODUCING SAME, AND ELECTROPHOTOGRAPHIC APPARATUS

CROSS-REFERENCE TO RELATED APPLICATION

This non-provisional Application for a U.S. Patent is a Continuation of International Application PCT/JP2013/085250 filed Dec. 27, 2013, the entire contents of which is hereby incorporated by reference.

BACKGROUND OF THE INVENTION

1. Field of the Invention

The present invention relates to an electrophotographic photoreceptor (also referred to below as a "photoreceptor"), a method of producing same, and an electrophotographic apparatus. The present invention more particularly relates to an electrophotographic photoreceptor that is principally formed of a conductive substrate and an organic material-containing photosensitive layer and that is used in, for example, electrophotography-based printers, copiers, and fax machines, and to a method of producing this electrophotographic photoreceptor and to an electrophotographic apparatus.

2. Background of the Related Art

The basic structure of an electrophotographic photoreceptor is a structure in which a photosensitive layer having a photoconductive function is disposed over a conductive substrate. Organic electrophotographic photoreceptors, which use organic compounds as the functional components responsible for charge generation and transport, have in recent years been the subject of active research and development based on advantages such as diversity of materials, high productivity, and safety, and their application to, for example, copiers and printers is moving forward.

The following functions are generally required in a photoreceptor: the ability to maintain a surface charge in the dark, the ability to generate charge upon exposure to light, and the ability to transport the generated charge. Photoreceptors include so-called monolayer photoreceptors, which are provided with a monolayer photosensitive layer in which these functions are combined, and so-called stacked (functionally separated) photoreceptors, which are provided with a photosensitive layer that has a stack of layers that are functionally separated primarily into a charge generation layer responsible for the function of charge generation upon exposure to light and a charge transport layer responsible for the function of maintaining a surface charge in the dark and the function of transporting the charge generated by the charge generation layer upon exposure to light.

The photosensitive layer is generally formed by the application onto a conductive substrate of a coating liquid provided by the dissolution or dispersion in an organic solvent of a charge generation material, a charge transport material, and a resin binder. Particularly in the case of the layer that is surfacemost in an organic photoreceptor, the use of polycarbonate, which exhibits an excellent flexibility and a good transparency to photoexposure and is resistant to the friction produced with the paper or toner-removal blade, as the organic binder, is frequently seen. Among the polycarbonates, the bisphenol Z-based polycarbonates are in wide use as the resin binder. The art in which such a polycarbonate is used as the resin binder is taught in, for example, Japanese Patent Application Laid-open No. S61-62040 (Patent Document 1).

So-called digital devices have become the mainstream for electrophotographic devices in recent years. With these digital devices, monochromatic light from, for example, an argon, helium-neon, or semiconductor laser or a light-emitting diode, is used as the exposure light source; the information, e.g., an image or characters, is digitized and converted to an optical signal; an electrostatic latent image is formed in the surface of the photoreceptor by irradiating the light onto the charged photoreceptor; and this electrostatic latent image is then visualized with toner.

Methods for charging the photoreceptor include noncontact charging methods, in which there is no contact between the photoreceptor and the charging member, e.g., a scorotron, and contact charging methods, in which the photoreceptor comes into contact with a charging member composed of a semiconducting rubber roller or brush. Compared with noncontact charging methods, contact charging methods offer the advantages, due to the occurrence of corona discharge in the immediate vicinity of the photoreceptor, of little ozone generation and enabling a reduction in the applied voltage. Thus, they have become the mainstream in particular in medium- to small-scale devices because they enable the realization of more compact and low-cost electrophotographic devices that generate little environmental pollution.

Wiping with a blade and a simultaneous development/cleaning process are the most commonly used means for cleaning the surface of the photoreceptor. In the case of a blade-based cleaning process, the residual untransferred toner on the photoreceptor surface is wiped off with a blade and recovered in a waste toner recovery box or returned to the developing unit. When such a cleaner based on wiping with a blade is employed, space is then required for the toner recovery box or for toner recycle and the fill status of the recovery box must also be monitored. In addition, when paper dust or external additives accumulate on the blade, scratches may be produced on the surface of the photoreceptor and the life of the photoreceptor may then be shortened. Processes have therefore been implemented in which the toner is recovered at the developing process or in which the residual toner adhered to the photoreceptor surface is magnetically or electrically lifted off immediately before the developing process.

Moreover, when a cleaning blade is used, the hardness of the blade and/or the contact pressure must be raised in order to improve the cleaning performance. This promotes wear in the photoreceptor surface, which can produce fluctuations in the potential and sensitivity and can thereby produce image abnormalities and, in the case of color devices, can produce problems with the color balance and reproducibility.

Methods for improving the surfacemost layer of the photoreceptor have been proposed in order to solve these problems. For example, methods are proposed in Japanese Patent Application Laid-open No. H1-205171 (Patent Document 2) and in Japanese Patent Application Laid-open No. H7-333881 (Patent Document 3) in which a filler is added to the surface layer of the photoreceptor in order to improve the durability of the photoreceptor surface. However, it is quite difficult with the methods for dispersing a filler in such a layer to bring about a uniform dispersion of the filler. Moreover, charge transport and charge generation become nonuniform due to the presence of aggregates of the filler, a lower transmissivity for the layer, and scattering of the exposure light by the filler, and this creates the risk of a reduction in the image properties. The addition of a dispersant is one method for improving the dispersibility of the filler, but in this case the dispersant itself influences the properties of the photoreceptor and as a consequence it has been difficult to bring about a balance between filler dispersibility and the properties of the photoreceptor.

In order to solve these problems, Japanese Patent Application Laid-open No. 2002-128883 (Patent Document 4) teaches a method in which the wear resistance is improved through the use of a resin having a siloxane structure introduced in the terminal structure. In Japanese Patent Application Laid-open No. 2005-115091 (Patent Document 5), the use of a polyarylate as a resin binder for the photosensitive layer is proposed and extensive and diverse investigations are carried out with the goal of, for example, improving the durability and mechanical strength. Japanese Patent Application Laid-open No. 2002-214807 (Patent Document 6) teaches a photoreceptor in which the following are used in the photosensitive layer: a polycarbonate resin and a polyarylate resin that has a siloxane structure obtained using a phenol-modified polysiloxane as the siloxane component. Japanese Patent Application Laid-open No. 2004-93865 (Patent Document 7) proposes an electrophotographic apparatus that is provided with a photoreceptor that contains a polyarylate resin structural unit. Japanese Patent Application Laid-open No. 2007-121751 (Patent Document 8) and Japanese Patent Application Laid-open No. 2010-96929 (Patent Document 9) propose a photoreceptor that uses a polyarylate resin in the photosensitive layer.

On the other hand, methods have been proposed in which a surface protective layer is formed on the photosensitive layer for the purpose of, for example, protecting the photosensitive layer, improving the mechanical strength, and improving the surface lubricity. However, the following problems have occurred with methods in which a surface-protective layer is formed: film formation on the charge transport layer has been problematic, and it has been difficult to bring about a satisfactory balance between the charge transport performance and the charge maintenance function.

As indicated above, the art disclosed in these patent documents cannot provide good maintenance of the electrical properties and/or image properties while at the same time achieving a satisfactory reduction in the amount of wear of the photoreceptor surface.

Therefore, an object of the present invention is to provide an electrophotographic photoreceptor that can provide additional reductions in the amount of surface wear while producing an excellent image. Further objects of the present invention are to provide a method of producing this electrophotographic photoreceptor and to provide an electrophotographic apparatus.

SUMMARY OF THE INVENTION

As a result of intensive investigations in order to solve the problems indicated above, the present inventors discovered that a highly durable electrophotographic photoreceptor can be realized by incorporating a resin having special structural characteristics in the layer exposed at the surface of the photoreceptor. The present invention was achieved based on this discovery.

Thus, the electrophotographic photoreceptor of the present invention has a photosensitive layer over a conductive substrate and is characterized in that the photosensitive layer contains a resin, for which a molecular structure optimized using molecular dynamic calculations is a helical structure, and a value, for this resin, of the ratio r/I between the diameter (r) and helix pitch (I) of the helical structure is in a range from 0.04 to 1.0.

The optimization calculations for the molecular structure of the resin can be carried out, for example, using a simulation such as J-OCTA (JSOL Corporation). First, the molecular dynamics simulation program to be used, the atomic model conditions, the number of atoms, and the force field parameters are selected; the temperature conditions, integration conditions, and optimization calculation conditions are set; and an optimized three-dimensional molecular structure is constructed. Then, for the resin for which the obtained molecular structure is a helical structure, the diameter (r) and the helix pitch (I) of the helical structure are determined from the molecular coordinates and the value of r/I is calculated. The present inventors discovered that an excellent printing durability is obtained by using, in the photosensitive layer exposed at the surface of the photoreceptor, a resin that has a molecular structure for which the value of this r/I is in the range from 0.04 to 1.0. It is hypothesized that, by the incorporation in the surface layer of a resin having a structure in which the value of r/I is in the indicated range, an effect in which the helical molecules making up the resin become intertwined with one another can be favorably obtained and the strength of the layer is then improved and the wear resistance is enhanced. When the value of r/I is less than 0.04, the helical structural unit of the molecules constituting the resin becomes large and a satisfactory intermolecular intertwining effect is not obtained and an improvement in the wearability is then not obtained. When, on the other hand, the value of r/I is larger than 1.0, the molecule has a narrow helix pitch and a satisfactory intermolecular intertwining does not develop, and due to this an improvement in the wearability is not obtained. In addition, because a large strain appears in the molecular structure, a molecular weight adequate for the formation of the photosensitive layer is not obtained due to steric hindrance by the molecular chain itself in the low degree of polymerization oligomeric state during the actual synthesis of the resin.

Specifically, an improvement in the wearability can be obtained in the present invention by using a polycarbonate resin or polyarylate resin that has a helical structure for which the value of r/I is in the indicated range. The structural units in a polyarylate resin having such a characteristic feature can be exemplified by the structural units given in the following chemical structural formula 1.

(A)

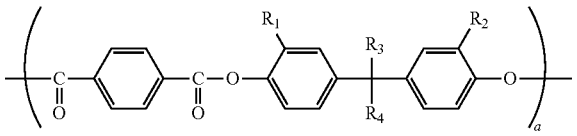

(B)

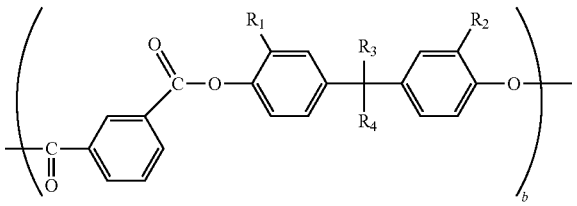

-continued (C)

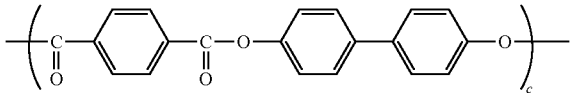

(D)

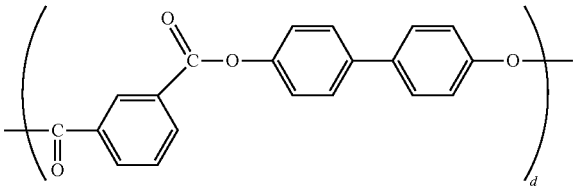

In chemical structural formula 1, substructure formulas (A), (B), (C), and (D) each represent a structural unit that constitutes the resin; a, b, c, and d respectively represent mol % of the structural units (A), (B), (C), and (D); a+b+c+d is 100 mol %; $R_1$ and $R_2$ may be the same or different and represent a $C_{1-8}$ alkyl group, a possibly substituted cycloalkyl group, or a possibly substituted aryl group; and $R_3$ and $R_4$ may be the same or different and represent a hydrogen atom, a $C_{1-8}$ alkyl group, a possibly substituted cycloalkyl group, or a possibly substituted aryl group, or $R_3$ and $R_4$ may form a cyclic structure together with the carbon atom to which $R_3$ and $R_4$ are bonded, and 1 or 2 arylene groups may be bonded to this cyclic structure.

In the photoreceptor of the present invention, the $R_1$ and $R_2$ in chemical structural formula 1 are preferably a $C_{1-8}$ straight-chain or monobranched alkyl group or a possibly substituted aryl group and $R_3$ and $R_4$ are preferably a hydrogen atom or a methyl group. The aryl group encompassed by $R_1$ and $R_2$ is also preferably a paraphenylene structure with a repeat number of 1 to 5.

In addition, c and d are preferably 0 mol % in the photoreceptor of the present invention where 100 mol % is the total amount a+b+c+d of the structural units given by chemical structural formula 1. The basis for this is as follows: when the structural units (C) and (D) are incorporated, synthesis is considered to become quite problematic in the case of a large monomer molecular weight for the structural units (A) and (B) and a large steric hindrance. In addition, a+b is preferably from 65 mol % to less than 100 mol % and is more preferably from 70 mol % to less than 100 mol %. When a+b is less than 65 mol %, the value of r/I is less than 0.04 and the solubility may also be inadequate. Moreover, the mol % ratio between a and b is preferably 90:10 to 10:90. When a is less than 10 mol %, an adequate film hardness may not be obtained. When, on the other hand, a exceeds 90 mol %, an adequate compatibility with the solvent and/or functional materials may not be obtained when the coating liquid is made.

The photoreceptor of the present invention may be a photoreceptor in which the photosensitive layer is provided with at least a charge generation layer and a charge transport layer and the charge transport layer contains the aforementioned resin and a charge transport material. In this case, the charge generation layer and the charge transport layer can be stacked over the conductive substrate in this sequence. In addition, the photoreceptor of the present invention may also be a photoreceptor in which the photosensitive layer contains the aforementioned resin and a charge generation material and a charge transport material, in which case the charge transport material preferably contains a hole transport material and an electron transport material. The photoreceptor of the present invention may also preferably be a photoreceptor in which the photosensitive layer is provided with at least a charge transport layer and a charge generation layer and the charge generation layer contains the aforementioned resin and a charge generation material and a charge transport material, and in this case the charge transport layer and the charge generation layer can be stacked over the conductive substrate in this sequence.

The method of the present invention for producing an electrophotographic photoreceptor contains a step of forming a photosensitive layer over a conductive substrate by coating the conductive substrate with a coating liquid that contains at least a resin binder, this method being characterized in that the resin binder contains a resin, for which a molecular structure optimized using molecular dynamic calculations is a helical structure and a value, for this resin, of the ratio r/I between the diameter (r) and helix pitch (I) of the helical structure is in a range from 0.04 to 1.0. The resin used in the production method of the present invention preferably contains the repeat units given by chemical structural formula 1.

The electrophotographic apparatus of the present invention is characteristically equipped with the aforementioned electrophotographic photoreceptor.

It has been shown that, through the use of a resin having the special structure described in the preceding as a resin binder in the photosensitive layer, the present invention can lower the amount of wear of the photoreceptor surface while maintaining the electrophotographic characteristics of the photoreceptor, and can also improve the mechanical strength. The mechanism here is unclear, but the following is hypothesized: when this resin is incorporated in the photosensitive layer, the molecules constituting the resin assume a helical structure in the layer; as a result, the number of intertwining points among the molecules in the layer increases; and this brings about an improvement in the durability to the wear caused by external forces that impinge on the photosensitive layer.

DETAILED DESCRIPTION OF THE INVENTION

Specific embodiments of the electrophotographic photoreceptor of the present invention are described in detail below with reference to the figures. The present invention is in no way limited by the description that follows.

Figure 1A:
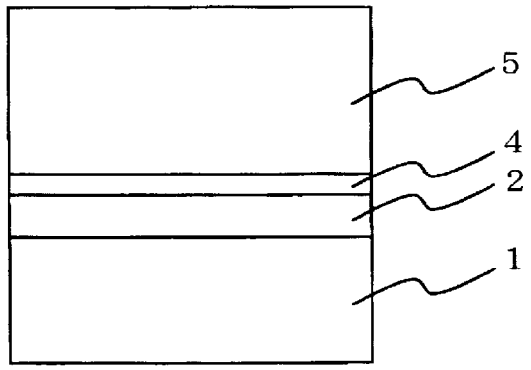
FIG. 1A is a schematic cross-sectional diagram that shows an example of a negative-charge, functionally separated stacked electrophotographic photoreceptor according to the present invention.
Figure 1B:
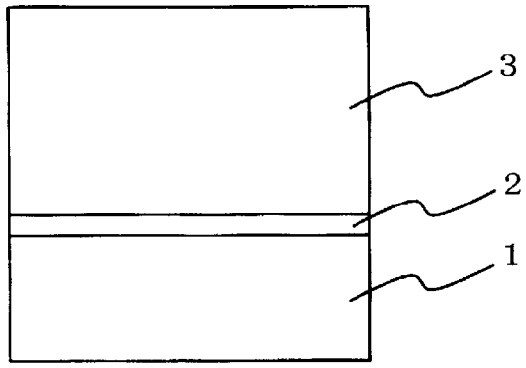
FIG. 1B is a schematic cross-sectional diagram that shows an example of a positive-charge monolayer electrophotographic photoreceptor according to the present invention.
Figure 1C:
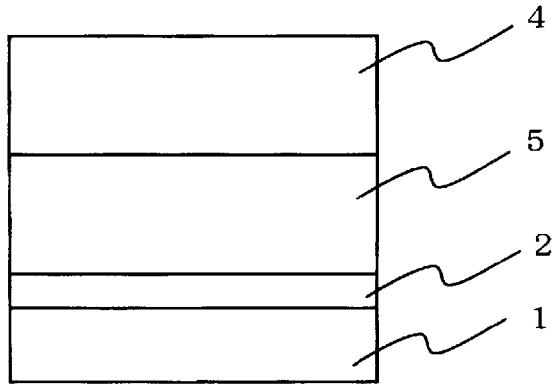
FIG. 1(*c*) is a schematic cross-sectional diagram that shows an example of a positive-charge, functionally separated stacked electrophotographic photoreceptor according to the present invention.

As previously noted, electrophotographic photoreceptors can be generally classified into monolayer photoreceptors, which are primarily used as positive-charge types, and, within the realm of stacked (functionally separated) photoreceptors, into negative-charge stacked photoreceptors and positive-charge stacked photoreceptors. FIG. 1 is a schematic cross-sectional diagram that shows an example of the electrophotographic photoreceptor of the present invention, and shows, respectively, FIG. 1A a negative-charge stacked electrophotographic photoreceptor, FIG. 1B a positive-charge monolayer electrophotographic photoreceptor, and FIG. 1C a positive-charge stacked electrophotographic photoreceptor. As shown in the figures, in the negative-charge stacked photoreceptor, an undercoat layer 2 and a photosensitive layer, which has a charge generation layer 4 provided with a charge generation function and a charge transport layer 5 provided with a charge transport function, are successively stacked on a conductive substrate 1. In the positive-charge monolayer photoreceptor, an undercoat layer 2 and a monolayer photosensitive layer 3, which has both a charge generation function and a charge transport function, are successively stacked on a conductive substrate 1. In the positive-charge stacked photoreceptor, an undercoat layer 2 and a photosensitive layer having a charge transport layer 5 provided with a charge transport function and a charge generation layer 4 provided with both a charge generation function and a charge transport function are successively stacked on a conductive substrate 1. The undercoat layer 2 may be disposed as necessary in any of the photoreceptor types. In addition, the "photosensitive layer" of the present invention encompasses both a monolayer photosensitive layer and a stacked photosensitive layer in which a charge generation layer and a charge transport layer are stacked.

The conductive substrate 1 fulfills the role of an electrode for the photoreceptor and at the same time is also a support for the individual layers that make up the photoreceptor, and it may have any shape, e.g., cylindrical, plate, film, and so forth. The material used for the conductive substrate 1, for example, may be a metal such as aluminum, stainless steel, or nickel or may be provided by the execution of a conductive treatment on the surface of, e.g., a glass or resin.

The undercoat layer 2 is a layer for which the principal component is a resin or is composed of a metal oxide film such as alumite. This undercoat layer 2 is disposed on an optional basis for the purpose of, for example, controlling charge injection from the conductive substrate 1 into the photosensitive layer, covering over defects in the surface of the conductive layer, and/or improving the adherence between the photosensitive layer and the conductive substrate 1. The resin material used in the undercoat layer 2 can be exemplified by insulating polymers such as casein, polyvinyl alcohol, polyamide, melamine, cellulose, and so forth, and by conductive polymers such as polythiophene, polypyrrole, polyaniline, and so forth. A single one of these resins may be used by itself or a mixture of a suitable combination may be used. In addition, a metal oxide, e.g., titanium dioxide, zinc oxide, and so forth, may be used incorporated in these resins.

The Negative-Charge Stacked Photoreceptor

The charge generation layer 4 in the negative-charge stacked photoreceptor is formed by a method, for example, in which a coating liquid having particles of a charge generation material dispersed in a resin binder is applied, and it generates charge when irradiated with light. It is essential that the charge generation layer 4 have a high charge-generating efficiency and at the same time have the ability to inject the generated charge into the charge transport layer 5, while a low electric field dependence and good injection even in a low electric field are desirable. For example, phthalocyanine compounds, e.g., X-type metal-free phthalocyanine, τ-type metal-free phthalocyanine, α-type titanyl phthalocyanine, β-type titanyl phthalocyanine, Y-type titanyl phthalocyanine, γ-type titanyl phthalocyanine, amorphous titanyl phthalocyanine, and ϵ-type copper phthalocyanine; azo pigments; anthanthrone pigments; thiapyrylium pigments; perylene pigments; perinone pigments; squarylium pigments; quinacridone pigments; and so forth may be used individually or in appropriate combinations, and an optimal substance may be selected in correspondence to the light wavelength region of the exposure light source used for image formation. The content of the charge generation material in the charge generation layer 4, expressed with reference to the solids fraction in the charge generation layer 4, is preferably from 20 to 80 mass % and is more preferably from 30 to 70 mass %.

The film thickness of the charge generation layer 4 is, as long as it exhibits a charge generation function, generally not more than 1 μm and preferably not more than 0.5 μm. The charge generation layer 4 used may also be mainly a charge generation material with, for example, a charge transport material and so forth added thereto. Suitable combinations of, for example, polycarbonate resin, polyester resin, polyamide resin, polyurethane resin, vinyl chloride resin, vinyl acetate resin, phenoxy resin, polyvinyl acetal resin, polyvinyl butyral resin, polystyrene resin, polysulfone resin, diallyl phthalate resin, and methacrylate ester resin polymers and copolymers can be used for the resin binder for the charge generation layer 4. In the case of a negative-charge stacked photoreceptor, the above-described helically structured resin may be used on an optional basis in the present invention as a resin binder for the charge generation layer 4.

The charge transport layer 5 is constructed mainly from a charge transport material and a resin binder. In the case of a negative-charge stacked photoreceptor, the above-described helically structured resin must be used in the present invention as a resin binder for the charge transport layer 5 that is disposed on the surface side of the photosensitive layer. This makes it possible to obtain the expected effects of the present invention.

The above-described helically structured resin may be used by itself or may be used mixed with another resin. The following can be used as this other resin: other polyarylate resins; various other polycarbonate resins, e.g., bisphenol A types, bisphenol Z types, bisphenol A-biphenyl copolymers, and bisphenol Z-biphenyl copolymers; polyphenylene resins; polyester resins; polyvinyl acetal resins; polyvinyl butyral resins; polyvinyl alcohol resins; vinyl chloride resins; vinyl acetate resins; polyethylene resins; polypropylene resins; acrylic resins; polyurethane resins; epoxy resins; melamine resins; silicone resins; polyamide resins; polystyrene resins; polyacetal resins; polysulfone resins; and methacrylate ester polymers and their copolymers. A mixture of resins of the same type, but with different molecular weights, may also be used.

The content of the resin binder in the charge transport layer 5, expressed with reference to the solids fraction in the charge transport layer 5, is preferably 10 to 90 mass % and more preferably 20 to 80 mass %. In addition, the content in this resin binder of the above-described helically structured resin is preferably in the range from 1 mass % to 100 mass % and is more preferably in the range from 5 mass % to 80 mass %.

The weight-average molecular weight of the above-described helically structured resin, according to analysis by gel permeation chromatography (GPC) as polystyrene, is preferably 5,000 to 250,000 and is more preferably 10,000 to 200,000.

Specific examples of the substructures (A) to (D), which are the structural units in chemical structural formula 1, are shown below as specific examples of the above-described helically structured resin. Moreover, specific examples of resins represented by chemical structural formula 1 are shown in the table below. However, the above-described helically structured resin according to the present invention is not limited to these exemplary structures.

A1

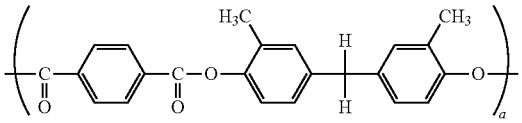

A2

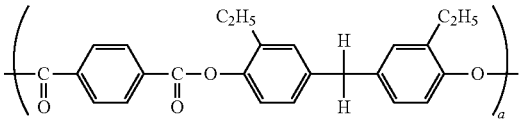

A3

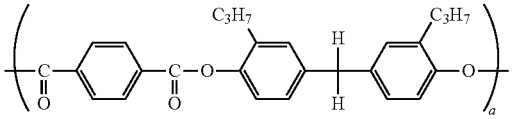

A4

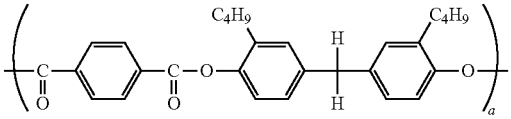

A5

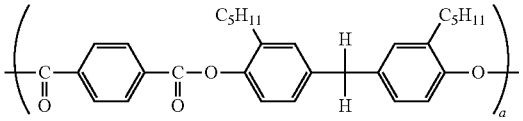

A6

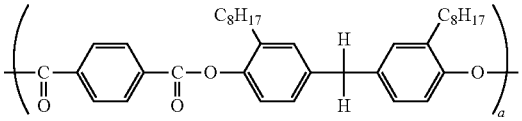

A7

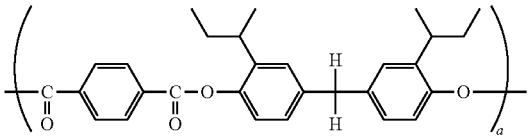

A8

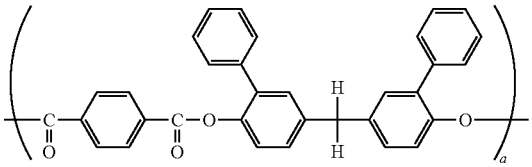

A9

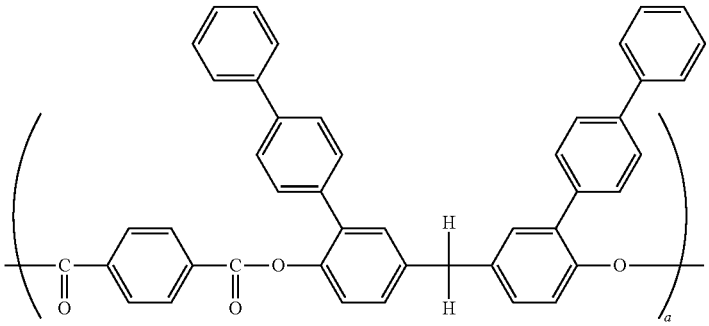

A10

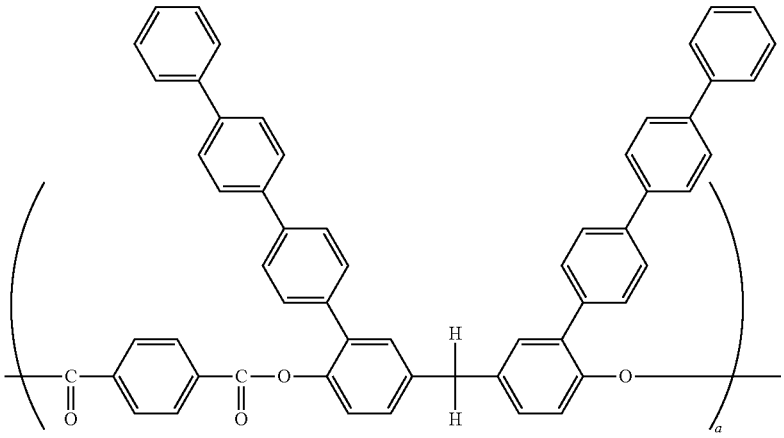

-continued
A11
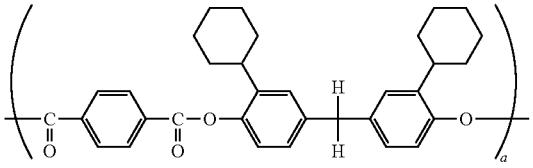
B1
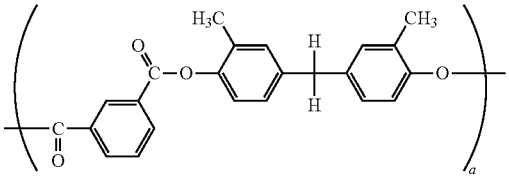
B2
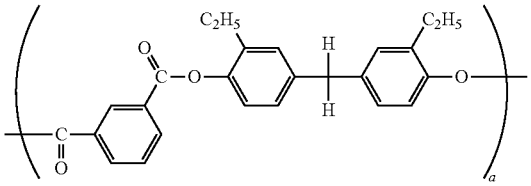
B3
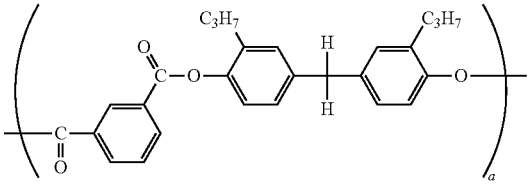
B4
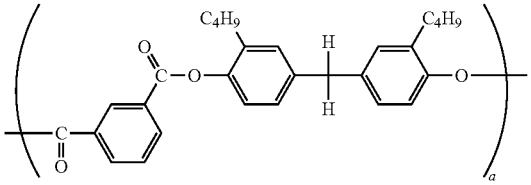
B5
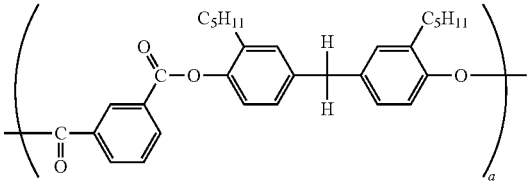
B6
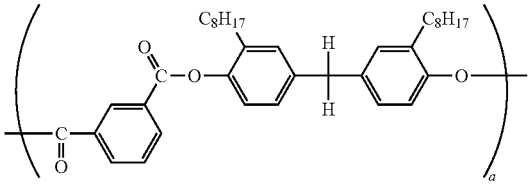
B7
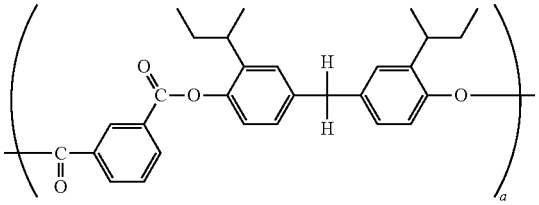
B8
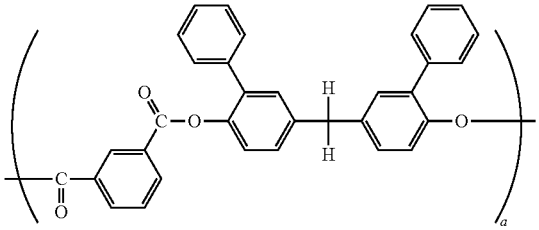
B9
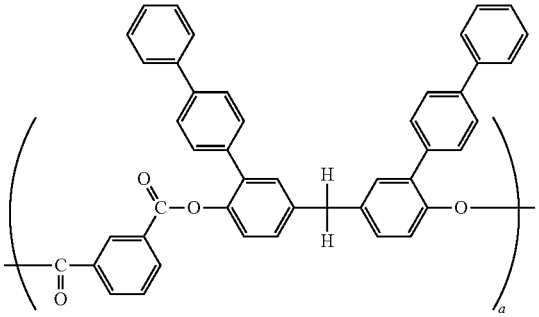

-continued

B10

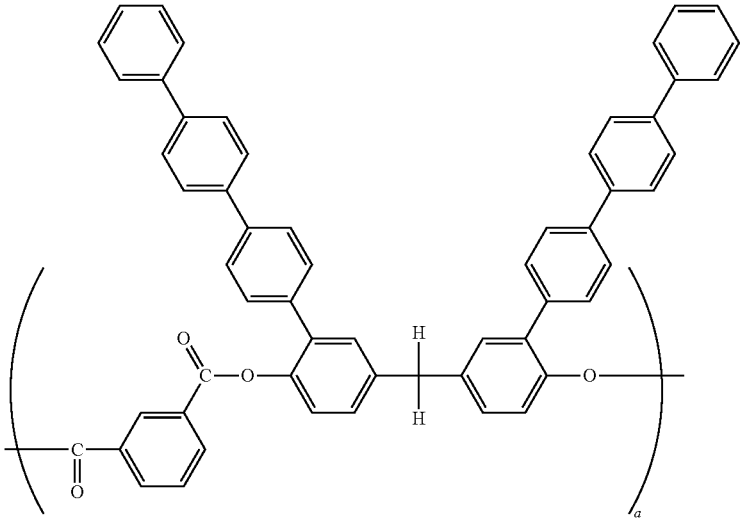

B11

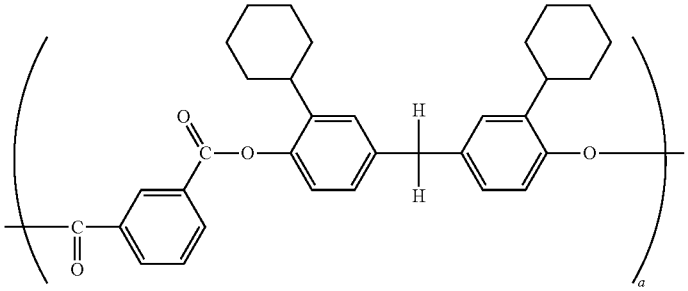

(C)

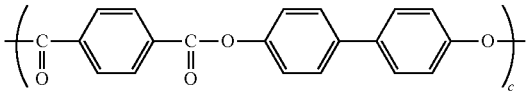

(D)

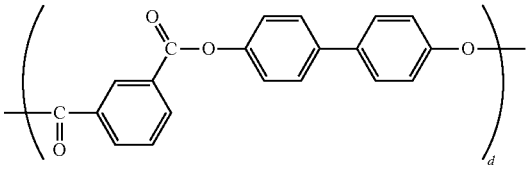

TABLE 1

| structure No. | substructural unit designation A | B | C | D |
|---|---|---|---|---|
| (I-1) | A1 | B1 | C1 | D1 |
| (I-2) | A2 | B2 | C1 | D1 |
| (I-3) | A3 | B3 | C1 | D1 |
| (I-4) | A4 | B4 | C1 | D1 |
| (I-5) | A5 | B5 | C1 | D1 |
| (I-6) | A6 | B6 | C1 | D1 |
| (I-7) | A7 | B7 | C1 | D1 |
| (I-8) | A8 | B8 | C1 | D1 |
| (I-9) | A9 | B9 | C1 | D1 |
| (I-10) | A10 | B10 | C1 | D1 |
| (I-11) | A11 | B11 | C1 | D1 |
| (I-12) | A1 | B1 | — | — |
| (I-13) | A2 | B2 | — | — |
| (I-14) | A3 | B3 | — | — |
| (I-15) | A4 | B4 | — | — |
| (I-16) | A5 | B5 | — | — |
| (I-17) | A6 | B6 | — | — |
| (I-18) | A7 | B7 | — | — |
| (I-19) | A8 | B8 | — | — |
| (I-20) | A9 | B9 | — | — |

TABLE 1-continued

| structure No. | substructural unit designation A | B | C | D |
|---|---|---|---|---|
| (I-21) | A10 | B10 | — | — |
| (I-22) | A11 | B11 | — | — |

For example, the bisphenols given by the following M1 to M12 can be used as constituent monomers for these resins (I-1) to (I-22), but there is no limitation to these.

M1

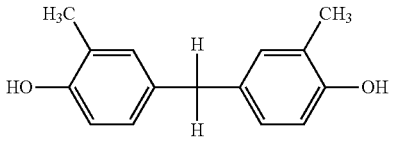

-continued

M2

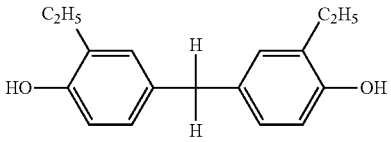

M3

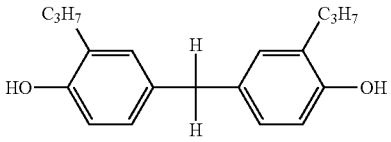

M4

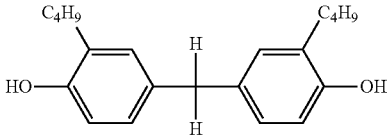

M5

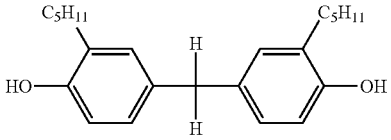

M6

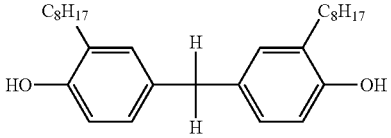

M7

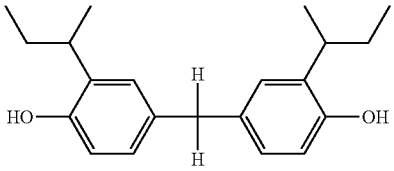

M8

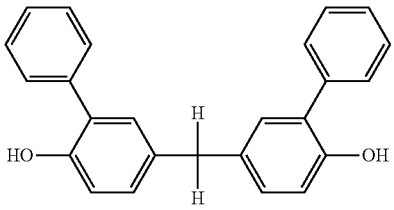

-continued

M9

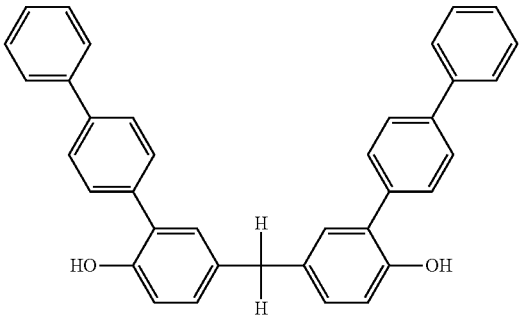

M10

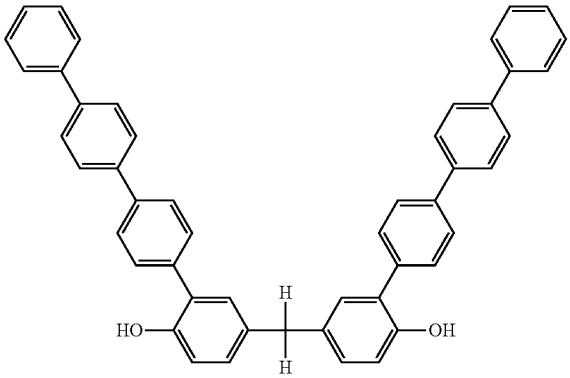

M11

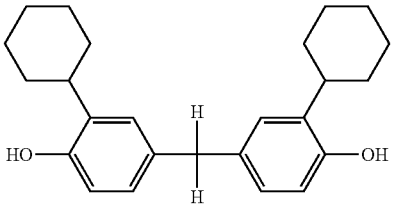

M12

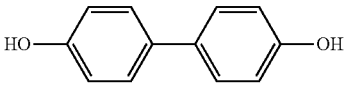

Various hydrazone compounds, styryl compounds, diamine compounds, butadiene compounds, indole compounds, and so forth can be used, individually or mixed in a suitable combination, as the charge transport material in the charge transport layer 5. This charge transfer material can be exemplified by the charge transfer materials given by the following (II-1) to (II-22), but there is no limitation to these.

II-1

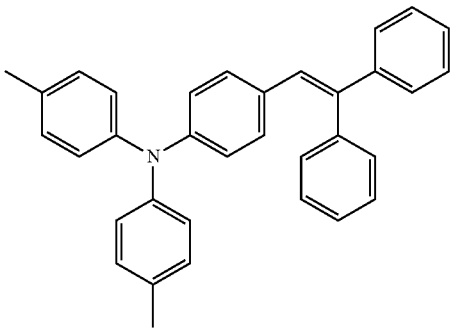

II-2

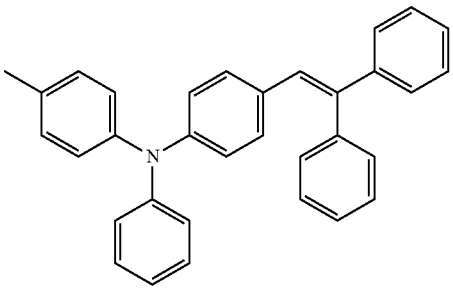

-continued
II-3
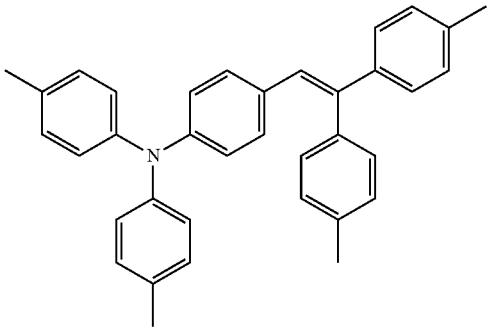
II-4
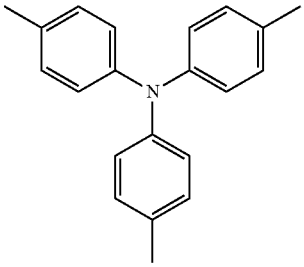
II-5
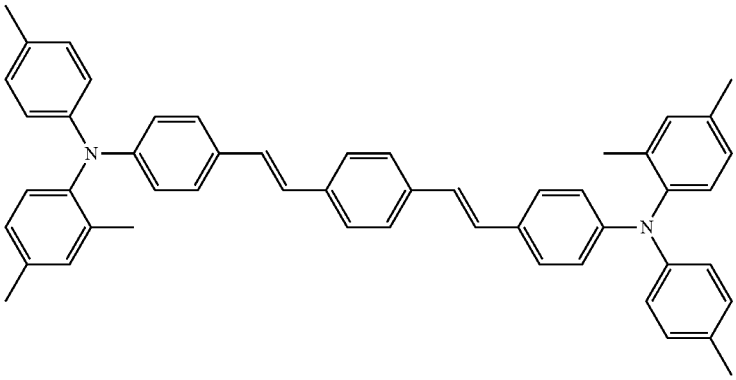
II-6
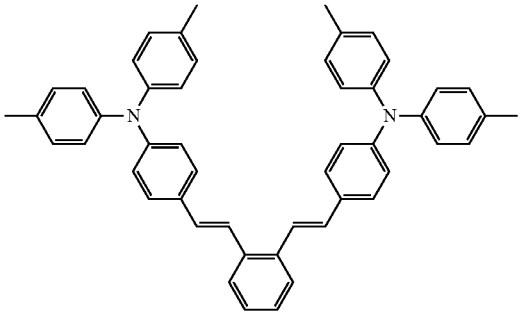
II-7
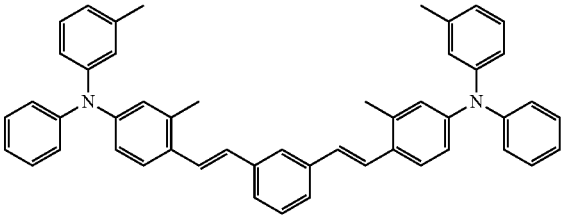
II-8
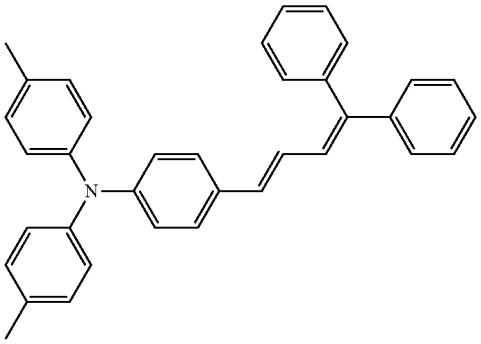
II-9
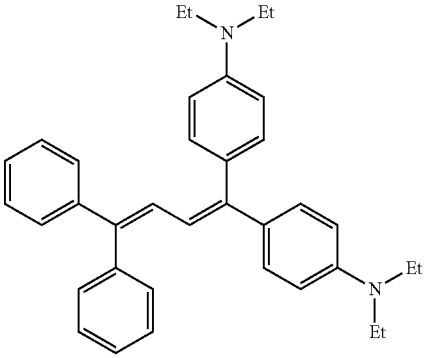

-continued
II-10
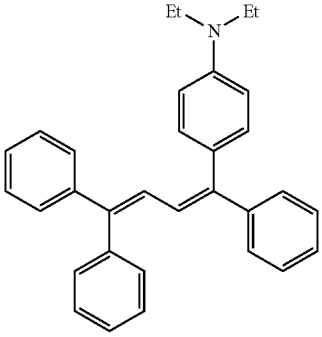
II-11
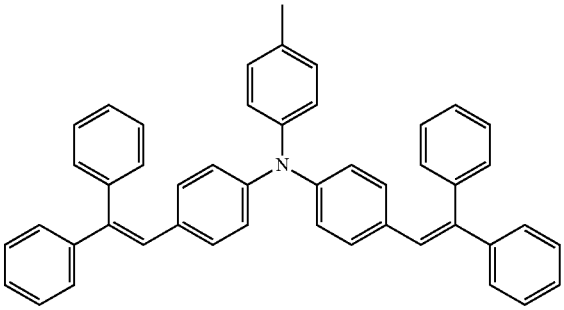
II-12
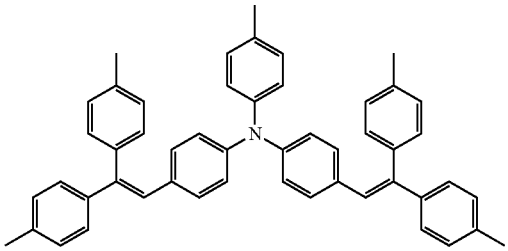
II-13
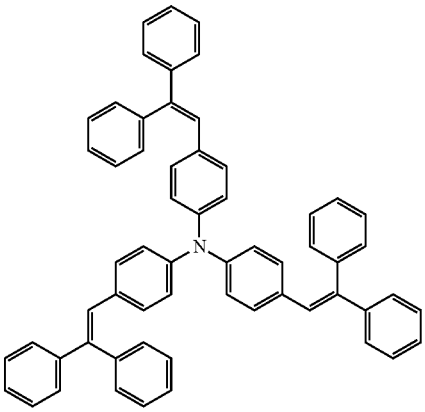
II-14
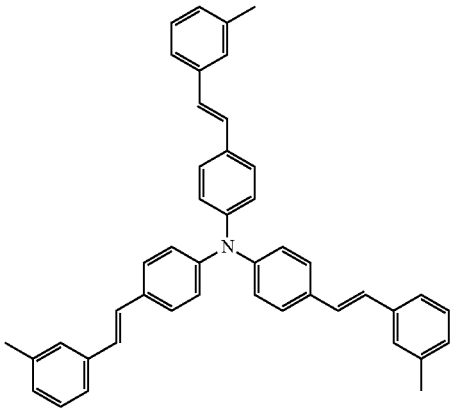
II-15
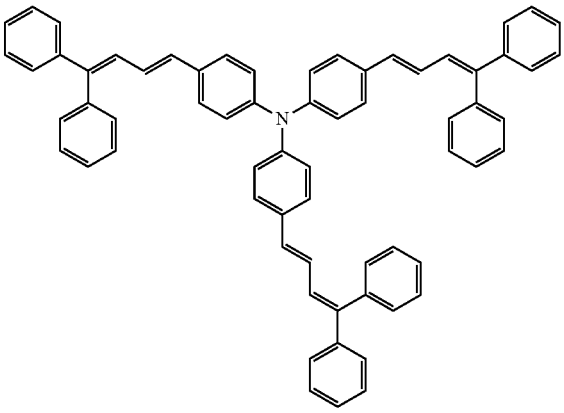
II-16
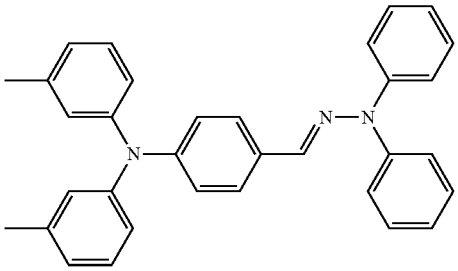
II-17
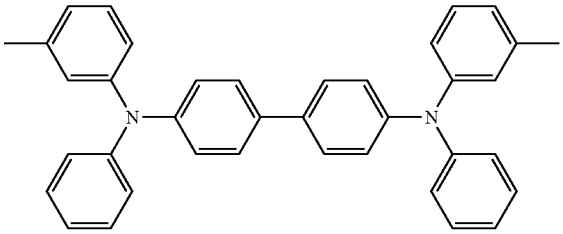

-continued

II-18

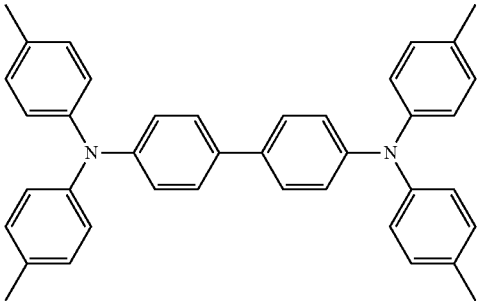

II-19

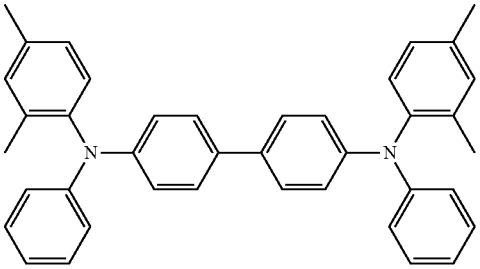

II-20

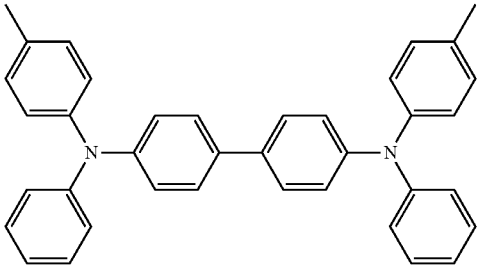

II-21

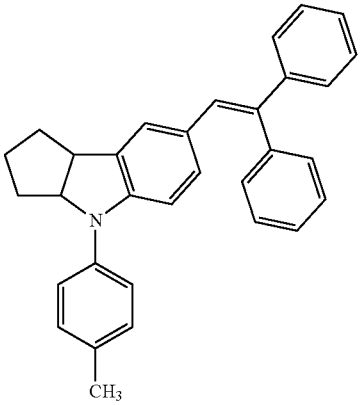

II-22

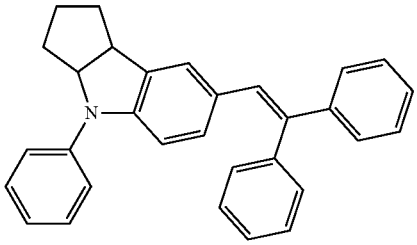

In order to maintain a surface potential that is effective from a practical standpoint, the film thickness of the charge transport layer 5 is preferably in the range from 3 to 50 μm and more preferably in the range from 15 to 40 μm.

The Positive-Charge Monolayer Photoreceptor

The monolayer photosensitive layer 3 in the positive-charge monolayer photoreceptor is composed mainly of a charge generation material, a hole transport material, an electron transport material (acceptor compound), and a resin binder.

In the case of a positive-charge monolayer photoreceptor, the above-described helically structured resin must be used in the present invention as a resin binder for the monolayer photosensitive layer 3. This makes it possible to obtain the expected effects of the present invention. This helically structured resin can be exemplified by the same such resins as described above.

The above-described helically structured resin may be used by itself as the resin binder for the monolayer photosensitive layer 3 or may be used mixed with another resin. The following can be used as this other resin: various other polycarbonate resins, e.g., bisphenol A types, bisphenol Z types, bisphenol A-biphenyl copolymers, and bisphenol Z-biphenyl copolymers; polyphenylene resins; polyester resins; polyvinyl acetal resins; polyvinyl butyral resins; polyvinyl alcohol resins; vinyl chloride resins; vinyl acetate resins; polyethylene resins; polypropylene resins; acrylic resins; polyurethane resins; epoxy resins; melamine resins; silicone resins; polyamide resins; polystyrene resins; polyacetal resins; other polyarylate resins; polysulfone resins; and methacrylate ester polymers and their copolymers. A mixture of resins of the same type, but with different molecular weights, may also be used.

The content of the resin binder, expressed with reference to the solids fraction in the monolayer photosensitive layer 3, is preferably 10 to 90 mass % and is more preferably 20 to 80 mass %. The content in this resin binder of the above-described helically structured resin is preferably in the range from 1 mass % to 100 mass % and more preferably in the range from 5 mass % to 80 mass %.

For example, a phthalocyanine pigment, azo pigment, anthanthrone pigment, perylene pigment, perinone pigment, polycyclic quinone pigment, squarylium pigment, thiapyrylium pigment, quinacridone pigment, and so forth may be used as the charge generation material in the monolayer photosensitive layer 3. A single one of these charge generation materials may be used by itself or two or more may be used in combination. In particular, a disazo pigment or trisazo pigment is preferably used for the azo pigment in the photoreceptor of the present invention; N,N'-bis(3,5-dimethylphenyl)-3,4:9,10-perylenebis(carboxyimide) is preferably used for the perylene pigment in the photoreceptor of the present invention; and a metal-free phthalocyanine, copper phthalocyanine, or titanyl phthalocyanine is preferably used for the phthalocyanine pigment in the photoreceptor of the present invention. In addition, the use is preferred of X-type metal-free phthalocyanine, τ-type metal-free phthalocyanine, ϵ-type copper phthalocyanine, α-type titanyl phthalocyanine, (β-type titanyl phthalocyanine, Y-type titanyl phthalocyanine, amorphous titanyl phthalocyanine, or a titanyl phthalocyanine that has a maximum peak in the CuKα x-ray diffraction spectrum at a Bragg angle 2θ of 9.6° as described in Japanese Patent Application Laid-open No. H8-209023 and U.S. Pat. Nos. 5,736,282 and 5,874,570, because this provides substantially improved effects with regard to the sensitivity, durability, and image quality. The content of the charge generation material, expressed with reference to the solids fraction in the monolayer photosensitive layer 3, is preferably 0.1 to 20 mass % and more preferably 0.5 to 10 mass %.

The following, for example, can be used as the hole transport material in the monolayer photosensitive layer 3: hydrazone compounds, pyrazoline compounds, pyrazolone compounds, oxadiazole compounds, oxazole compounds, arylamine compounds, benzidine compounds, stilbene compounds, styryl compounds, poly-N-vinylcarbazoles, polysilanes, and so forth. A single one of these hole transport materials may be used by itself or a combination of two or more may be used. The hole transport material used in the present invention preferably has an excellent transport capacity for the holes generated by irradiation with light and in addition is suitable for combination with the charge generation material. The content of the hole transport material, expressed with reference to the solids fraction of the monolayer photosensitive layer 3, is preferably 3 to 80 mass % and more preferably 5 to 60 mass %.

The electron transport material (acceptor compound) in the monolayer photosensitive layer 3 can be exemplified by succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, choranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compounds, quinone compounds, benzoquinone compounds, diphenoquinone compounds, naphthoquinone compounds, anthraquinone compounds, stilbenequinone compounds, azoquinone compounds, and so forth. A single one of these electron transport materials may be used by itself or a combination of two or more may be used. The content of the electron transport material, expressed with reference to the solids fraction of the monolayer photosensitive layer 3, is preferably 1 to 50 mass % and more preferably 5 to 40 mass %.

In order to maintain a surface potential that is effective from a practical standpoint, the film thickness of the monolayer photosensitive layer 3 is preferably in the range from 3 to 100 μm and is more preferably in the range from 5 to 40 μm.

The Positive-Charge Stacked Photoreceptor

The charge transport layer 5 in the positive-charge stacked photoreceptor is formed mainly from a charge transport material and a resin binder. The same materials as described in relation to the charge transport layer 5 of the negative-charge stacked photoreceptor can be used as the charge transport material and resin binder here. The content of each individual material and the film thickness of the charge transport layer 5 can also be the same as for the negative-charge stacked photoreceptor. In the case of the positive-charge stacked photoreceptor, the above-described helically structured resin may be used on an optional basis in the present invention as a resin binder in the charge transport layer 5.

The charge generation layer 4 disposed on the charge transport layer 5 is composed mainly of a charge generation material, a hole transport material, an electron transport material (acceptor compound), and a resin binder. The same materials as described in relation to the monolayer photosensitive layer 3 of the monolayer photoreceptor may be used as the charge generation material, hole transport material, electron transport material, and resin binder. The content of each individual material and the film thickness of the charge generation layer 4 may be the same as for the monolayer photosensitive layer 3 of the monolayer photoreceptor. In the case of the positive-charge stacked photoreceptor, the above-described helically structured resin must be used in the present invention as a resin binder for the charge generation layer 4 disposed on the surface side of the photosensitive layer. This makes it possible to obtain the expected effects of the present invention.

In order to enhance the environmental resistance and the stability with respect to harmful light, the photosensitive layer, in either the stacked or monolayer configuration, may contain a deterioration inhibitor such as an oxidation inhibitor and/or a photostabilizer. Compounds used for these purposes can be exemplified by chromanol derivatives such as tocopherol and their ester compounds, polyarylalkane compounds, hydroquinone derivatives, etherified compounds, dietherified compounds, benzophenone derivatives, benzotriazole derivatives, thioether compounds, phenylenediamine derivatives, phosphonate esters, phosphite esters, phenol compounds, hindered phenol compounds, straight-chain amine compounds, cyclic amine compounds, and hindered amine compounds.

In addition, in order to enhance the leveling behavior of the film that has been formed and impart lubricity, these photosensitive layers may also contain a leveling agent, e.g., a silicone oil or fluorinated oil. The following may also be incorporated in order to adjust the film hardness and/or lower the coefficient of friction and impart lubricity: metal oxides such as silicon oxide (silica), titanium oxide, zinc oxide, calcium oxide, aluminum oxide (alumina), and zirconium oxide; metal sulfates such as barium sulfate and calcium sulfate; finely divided particles of a metal nitride such as silicon nitride and aluminum nitride; particles of a fluororesin such as a tetrafluoroethylene resin; and fluorinated comb graft polymer resins. Moreover, other known additives may also be incorporated as necessary within a range in which the electrophotographic characteristics are not significantly impaired.

The Electrophotographic Apparatus

The effects expected for the electrophotographic photoreceptor of the present invention are obtained by using it in the various machine processes. In specific terms, satisfactory effects can be obtained with charging processes such as contact charging configurations that use a roller or brush as well as noncontact charging configurations that use, for example, a corotron or scorotron, and with development processes such as noncontact developing regimes and contact developing regimes that use a nonmagnetic single-component, magnetic single-component, or magnetic two-component developing scheme.

Figure 2:
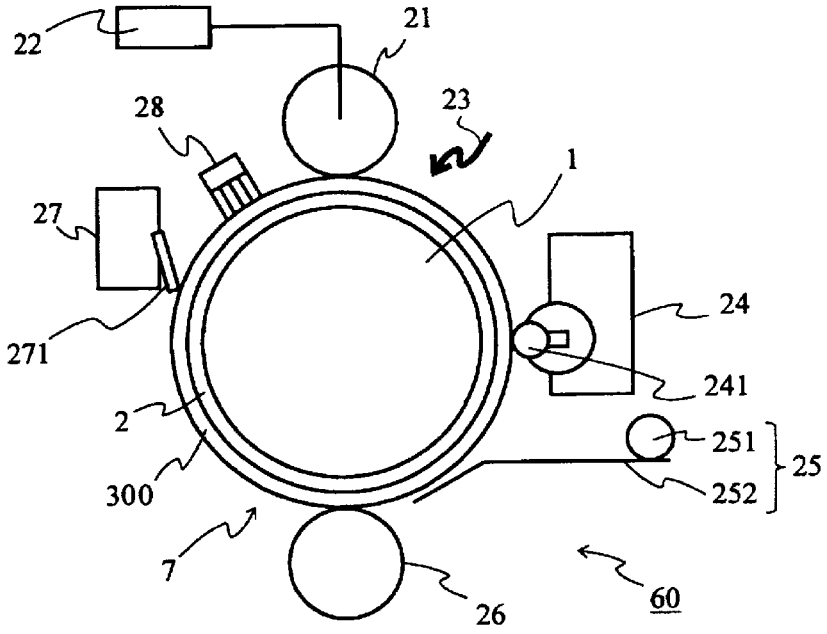
FIG. 2 is a schematic structural diagram that shows an example of the electrophotographic apparatus according to the present invention.

FIG. 2 shows a schematic structural diagram of an example of the structure of the electrophotographic apparatus according to the present invention. The electrophotographic apparatus 60 according to the present invention that is shown in the diagram is equipped with a photoreceptor 7 of the present invention that contains a conductive substrate 1, and, coated on the outer circumference thereof, an undercoat layer 2 and a photosensitive layer 300. This electrophotographic apparatus 60 is provided with a roller charging member 21 disposed at the outer periphery of the photoreceptor 7, a high-voltage power supply 22 that feeds an application voltage to this roller charging member 21, an imagewise exposure member 23, a developing device 24 provided with a developing roller 241, a paper feed member 25 provided with a paper feed roller 251 and a paper feed guide 252, a transfer charging device (direct charging type) 26, a cleaning apparatus 27 provided with a cleaning blade 271, and a neutralization member 28. The electrophotographic apparatus 60 of the present invention may also be a color printer.

EXAMPLES

Specific embodiments of the present invention are more particularly described below using examples, but, insofar as its essential features are not exceeded, the present invention is not limited by the following examples.

Resin Production

Production Example 1: Method of Producing Polyarylate Copolymer Resin (III-1)

Figure 3:
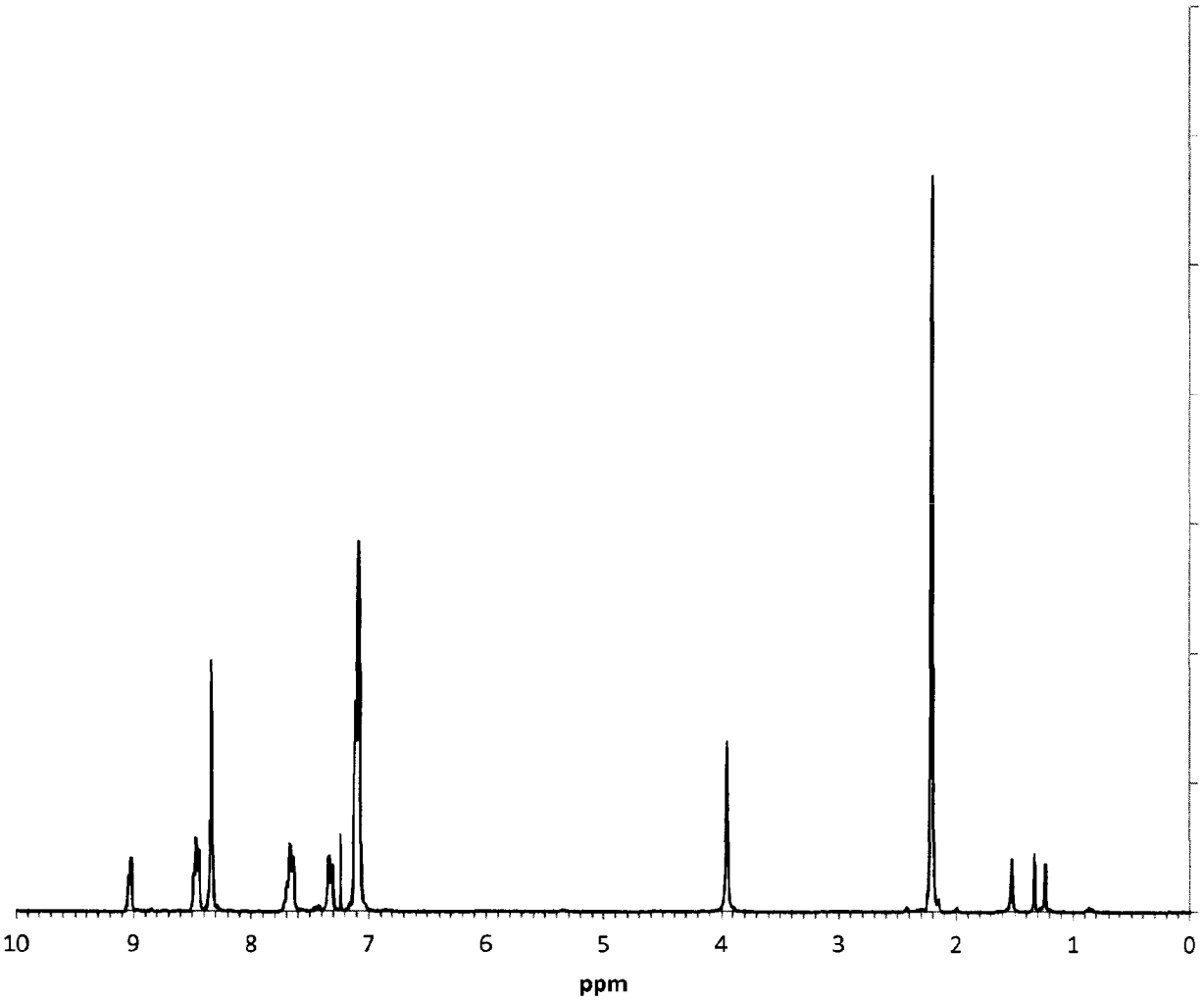
FIG. 3 is a $^1$H-NMR spectrum of polyarylate copolymer resin (III-1).

Into a 2-L four-neck flatbottom flask, 540 mL ion-exchanged water, 12.4 g NaOH, 0.459 g p-tert-butylphenol, 24.279 g of the above-described monomer M1 (2,6-bis(4-hydroxy-3-methylphenyl)methane), 4.95 g biphenol (abbreviated below as "BP"), and 0.272 g tetrabutylammonium bromide were introduced and a solution (i) was prepared. A solution (ii) was then prepared in which 12.27 g terephthaloyl chloride and 14.99 g isophthaloyl chloride were dissolved in 540 mL of dry methylene chloride. Solution (i) was first added dropwise to solution (ii) and stirring was performed for 2 hours to carry out a reaction. After the completion of the reaction, neutralization was carried out with 4.74 mL acetic acid and dilution was performed by the supplemental addition of 360 mL methylene chloride. The aqueous phase was separated and this was reprecipitated with 4-fold (volume) methanol. After drying for 2 hours at 60° C., washing was performed by making the obtained product into the 5% solution with methylene chloride and adding this to 3 L of ion-exchanged water and reprecipitating the resin. This washing was performed until the conductivity of the wash water reached 1 μS/m or less. The recovered resin was again dissolved at 5 mass % in methylene chloride and reprecipitation was performed by dropwise addition to 5-fold acetone that was being stirred. The precipitate was filtered and dried for 2 hours at 60° C. to obtain 42.24 g of the target polymer. The $^{1}$H-NMR spectrum in THF-d8 solution of this polyarylate copolymer resin (III-1) is given in FIG. 3, and its copolymerization ratio is as follows: a:b:c:d=36.0:44.0:9.0:11.0.

A molecular weight of 150,000 was obtained when the weight-average molecular weight as polystyrene of this polyarylate copolymer resin (III-1) was measured by GPC analysis.

Production Example 2: Method of Producing Polyarylate Copolymer Resin (III-2)

The synthesis was carried out as in Production Example 1, but changing the monomer M1 in Production Example 1 to M2 and adding 27.262 g thereof. The obtained polyarylate copolymer resin is designated (III-2).

Production Example 3: Method of Producing Polyarylate Copolymer Resin (III-3)

The synthesis was carried out as in Production Example 1, but changing the monomer M1 in Production Example 1 to M3 and adding 30.245 g thereof. The obtained polyarylate copolymer resin is designated (III-3).

Production Example 4: Method of Producing Polyarylate Copolymer Resin (III-4)

The synthesis was carried out as in Production Example 1, but changing the monomer M1 in Production Example 1 to M4 and adding 33.229 g thereof. The obtained polyarylate copolymer resin is designated (III-4).

Production Example 5: Method of Producing Polyarylate Copolymer Resin (III-5)

The synthesis was carried out as in Production Example 1, but changing the monomer M1 in Production Example 1 to M5 and adding 36.212 g thereof. The obtained polyarylate copolymer resin is designated (III-5).

Production Example 6: Method of Producing Polyarylate Copolymer Resin (III-6)

The synthesis was carried out as in Production Example 1, but changing the monomer M1 in Production Example 1 to M6 and adding 45.163 g thereof. The obtained polyarylate copolymer resin is designated (III-6).

Production Example 7: Method of Producing Polyarylate Copolymer Resin (III-7)

The synthesis was carried out as in Production Example 1, but changing the monomer M1 in Production Example 1 to M7 and adding 33.229 g thereof. The obtained polyarylate copolymer resin is designated (III-7).

Production Example 8: Method of Producing Polyarylate Copolymer Resin (III-8)

The synthesis was carried out as in Production Example 1, but changing the monomer M1 in Production Example 1 to M8 and adding 37.481 g thereof. The obtained polyarylate copolymer resin is designated (III-8).

Production Example 9: Method of Producing Polyarylate Copolymer Resin (III-9)

The synthesis was carried out as in Production Example 1, but changing the monomer M1 in Production Example 1 to M9 and adding 53.667 g thereof. The obtained polyarylate copolymer resin is designated (III-9).

Production Example 10: Method of Producing Polyarylate Copolymer Resin (III-10)

The synthesis was carried out as in Production Example 1, but changing the monomer M1 in Production Example 1 to M10 and adding 69.852 g thereof. The obtained polyarylate copolymer resin is designated (III-10).

Production Example 11: Method of Producing Polyarylate Copolymer Resin (III-11)

The synthesis was carried out as in Production Example 1, but changing the monomer M1 in Production Example 1 to M11 and adding 38.767 g thereof. The obtained polyarylate copolymer resin is designated (III-11).

Production Example 12: Method of Producing Polyarylate Copolymer Resin (III-12)

The synthesis was carried out as in Production Example 7, but using 37.383 g of the monomer M7 used in Production Example 7 and using 2.48 g BP. The obtained polyarylate copolymer resin is designated (III-12).

Production Example 13: Method of Producing Polyarylate Copolymer Resin (III-13)

The synthesis was carried out as in Production Example 7, but using 41.536 g of the monomer M7 used in Production Example 7 and omitting the BP. The obtained polyarylate copolymer resin is designated (III-13).

Production Example 14: Method of Producing Polyarylate Copolymer Resin (III-14)

The synthesis was carried out as in Production Example 13, but using the monomer M13 indicated below for the monomer M7 used in Production Example 13 and adding 30.348 g thereof. The obtained polyarylate copolymer resin is designated (III-14) as follows.

M13

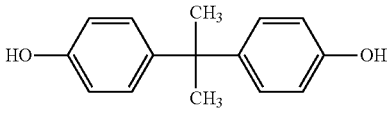

Production Example 15: Method of Producing Polyarylate Copolymer Resin (III-15)

The synthesis was carried out as in Production Example 13, but using the monomer M14 indicated below for the monomer M7 used in Production Example 13 and adding 26.618 g thereof. The obtained polyarylate copolymer resin is designated (III-15) as follows.

M14

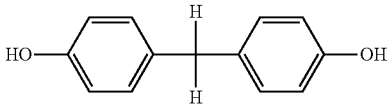

Production Example 16: Method of Producing Polyarylate Copolymer Resin (III-16)

The synthesis was carried out as in Production Example 7, but using 24.922 g of the monomer M7 used in Production Example 7 and using 9.90 g BP. The obtained polyarylate copolymer resin is designated (III-16).

Production Example 17: Method of Producing Polyarylate Copolymer Resin (III-17)

The synthesis was carried out as in Production Example 7, but using 20.768 g of the monomer M7 used in Production Example 7 and using 12.38 g BP. The obtained polyarylate copolymer resin is designated (III-17).

Production of a Negative-Charge Stacked Photoreceptor

Example 1

5 mass parts of an alcohol-soluble nylon (product name "CM8000" from Toray Industries, Inc.) and 5 mass parts of finely divided particles of an aminosilane-treated titanium oxide were dissolved and dispersed in 90 mass parts methanol to prepare a coating liquid 1. This coating liquid 1 was applied by dip coating as an undercoat layer 2 on the outer circumference of an aluminum cylinder having an outer diameter of 30 mm as a conductive substrate 1, and an undercoat layer 2 having a film thickness of 3 μm was formed by drying for 30 minutes at a temperature of 100° C.

A coating liquid 2 was prepared by dissolving and dispersing 1 mass parts of Y-titanyl phthalocyanine as a charge generation material and 1.5 mass parts of a polyvinyl butyral resin (product name "S-LEC KS-1" from Sekisui Chemical Co., Ltd.) as a resin binder in 60 mass parts dichloromethane. This coating liquid 2 was applied by dip coating on the aforementioned undercoat layer 2, and a charge generation layer 4 with a film thickness of 0.3 μm was formed by drying for 30 minutes at a temperature of 80° C.

A coating liquid 3 was prepared by dissolving 90 mass parts of a compound with the following structural formula

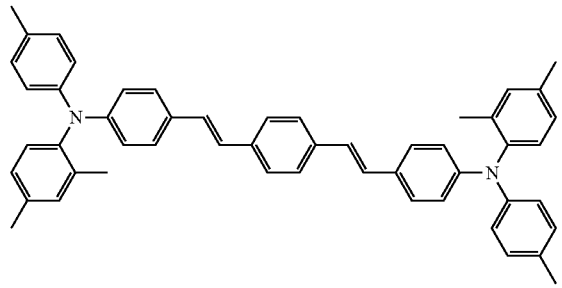

as a charge transport material and 110 mass parts of the polyarylate copolymer resin (III-1) of Production Example 1 as a resin binder in 1000 mass parts dichloromethane. The negative-charge stacked photoreceptor was then produced by applying the coating liquid 3 by dip coating on the aforementioned charge generation layer 4 and forming a charge transport layer 5 having a film thickness of 25 μm by drying for 60 minutes at a temperature of 90° C.

Example 2

A photoreceptor was produced by the same method as in Example 1, but changing the polyarylate copolymer resin (III-1) of Production Example 1 used in Example 1 to the polyarylate copolymer resin (III-2) of Production Example 2.

Example 3

A photoreceptor was produced by the same method as in Example 1, but changing the polyarylate copolymer resin (III-1) of Production Example 1 used in Example 1 to the polyarylate copolymer resin (III-3) of Production Example 3.

Example 4

A photoreceptor was produced by the same method as in Example 1, but changing the polyarylate copolymer resin (III-1) of Production Example 1 used in Example 1 to the polyarylate copolymer resin (III-4) of Production Example 4.

Example 5

A photoreceptor was produced by the same method as in Example 1, but changing the polyarylate copolymer resin (III-1) of Production Example 1 used in Example 1 to the polyarylate copolymer resin (III-5) of Production Example 5.

Example 6

A photoreceptor was produced by the same method as in Example 1, but changing the polyarylate copolymer resin (III-1) of Production Example 1 used in Example 1 to the polyarylate copolymer resin (III-6) of Production Example 6.

Example 7

A photoreceptor was produced by the same method as in Example 1, but changing the polyarylate copolymer resin (III-1) of Production Example 1 used in Example 1 to the polyarylate copolymer resin (III-7) of Production Example 7.

Example 8

A photoreceptor was produced by the same method as in Example 1, but changing the polyarylate copolymer resin (III-1) of Production Example 1 used in Example 1 to the polyarylate copolymer resin (III-8) of Production Example 8.

Example 9

A photoreceptor was produced by the same method as in Example 1, but changing the polyarylate copolymer resin (III-1) of Production Example 1 used in Example 1 to the polyarylate copolymer resin (III-9) of Production Example 9.

Example 10

A photoreceptor was produced by the same method as in Example 1, but changing the polyarylate copolymer resin (III-1) of Production Example 1 used in Example 1 to the polyarylate copolymer resin (III-10) of Production Example 10.

Example 11

A photoreceptor was produced by the same method as in Example 1, but changing the polyarylate copolymer resin (III-1) of Production Example 1 used in Example 1 to the polyarylate copolymer resin (III-11) of Production Example 11.

Example 12

A photoreceptor was produced by the same method as in Example 1, but changing the polyarylate copolymer resin (III-1) of Production Example 1 used in Example 1 to the polyarylate copolymer resin (III-12) of Production Example 12.

Example 13

A photoreceptor was produced by the same method as in Example 1, but changing the polyarylate copolymer resin (III-1) of Production Example 1 used in Example 1 to the polyarylate copolymer resin (III-13) of Production Example 13.

Example 14

A photoreceptor was produced by the same method as in Example 7, but changing the charge transport material used in Example 7 to the compound given by the following structural formula.

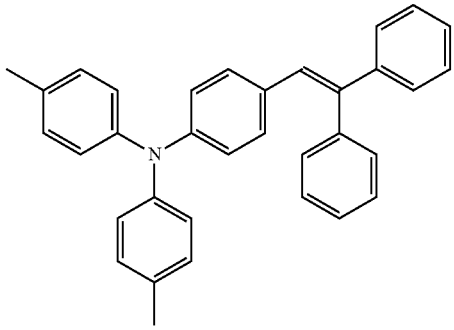

Comparative Example 1

A photoreceptor was produced by the same method as in Example 1, but changing the polyarylate copolymer resin (III-1) of Production Example 1 used in Example 1 to the polyarylate copolymer resin (III-14) of Production Example 14.

Comparative Example 2

A photoreceptor was produced by the same method as in Example 1, but changing the polyarylate copolymer resin (III-1) of Production Example 1 used in Example 1 to the polyarylate copolymer resin (III-15) of Production Example 15.

Comparative Example 3

A photoreceptor was produced by the same method as in Example 1, but changing the polyarylate copolymer resin (III-1) of Production Example 1 used in Example 1 to a polycarbonate resin A (S-3000 from Mitsubishi Engineering-Plastics Corporation)(referred to below as "III-18").

Comparative Example 4

A photoreceptor was produced by the same method as in Example 1, but changing the polyarylate copolymer resin (III-1) of Production Example 1 used in Example 1 to the polyarylate copolymer resin (III-16) of Production Example 16.

Comparative Example 5

A photoreceptor was produced by the same method as in Example 1, but changing the polyarylate copolymer resin (III-1) of Production Example 1 used in Example 1 to the polyarylate copolymer resin (III-17) of Production Example 17.

Production of a Positive-Charge Monolayer Photoreceptor

Example 15

A coating liquid 4, prepared by the dissolution with stirring of 0.2 mass parts of a vinyl chloride-vinyl acetate-vinyl alcohol copolymer (product name "Solbin TA5R" from Nissin Chemical Industry Co., Ltd.) in 99 mass parts methyl ethyl ketone, was applied as an undercoat layer 2 by dip coating on the outer circumference of an aluminum cylinder having an outer diameter of 24 mm as a conductive substrate 1, and an undercoat layer 2 with a film thickness of 0.1 μm was formed by drying for 30 minutes at a temperature of 100° C.

A coating liquid 5 was prepared by the dissolution and dispersion in 350 mass parts tetrahydrofuran of 1 mass parts of a metal-free phthalocyanine with the following formula as a charge generation material,

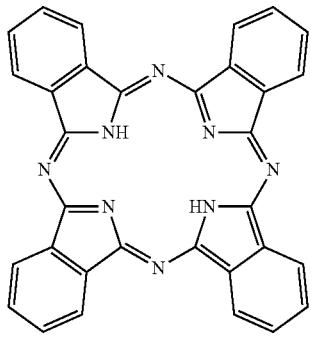

30 mass parts of a stilbene compound with the following general formula (II-1)

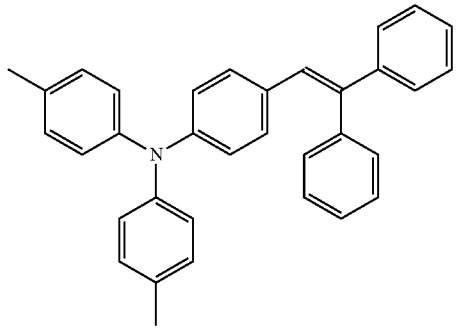

and 15 mass parts of a stilbene compound with the following formula as hole transport materials,

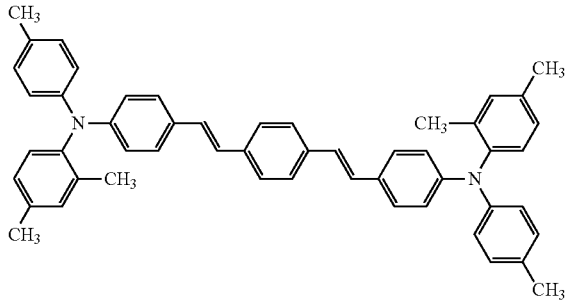

30 mass parts of a compound with the following formula as an electron transport material,

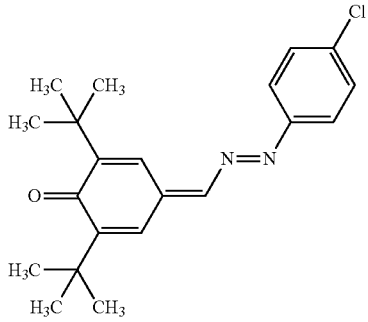

and 55 mass parts of the polyarylate copolymer resin (III-1) of Production Example 1 as the binder resin; this coating liquid 5 was applied by dip coating on the aforementioned undercoat layer 2; and the monolayer photoreceptor was produced by drying for 60 minutes at a temperature of 100° C. to form a photosensitive layer 3 having a film thickness of 25 μm.

Example 16

A photoreceptor was produced by the same method as in Example 15, but changing the stilbene compound (II-1) used in Example 15 as a hole transport material to the compound given by the following formula (II-8).

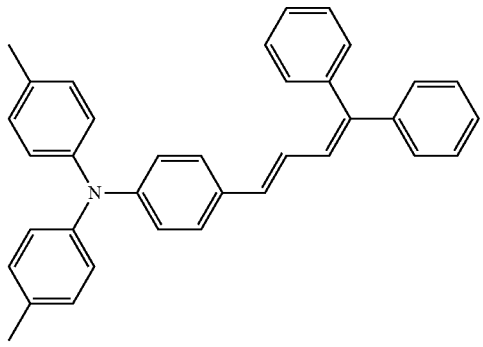

Comparative Example 6

A photoreceptor was produced by the same method as in Example 16, but changing the polyarylate copolymer resin (III-1) of Production Example 1 used in Example 16 to the polyarylate copolymer resin (III-16) of Production Example 16.

Production of a Positive-Charge Stacked Photoreceptor

Example 17

A coating liquid 6 was prepared by dissolving 50 mass parts of a compound with the following formula as a charge transport material

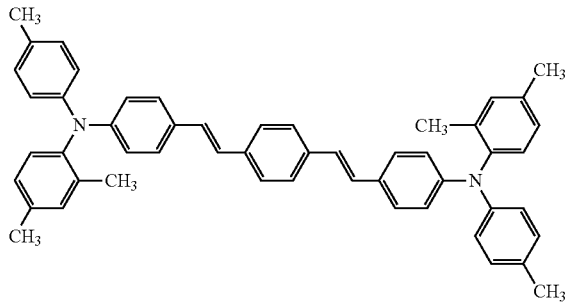

and 50 mass parts of a Z-type polycarbonate (PCZ-500 from Mitsubishi Gas Chemical Company, Inc.) as binder resin in 800 mass parts dichloromethane. A charge transport layer 5 having a film thickness of 15 μm was formed by applying this coating liquid 6 by dip coating on the outer circumference of an aluminum cylinder having an outer diameter of 24 mm as a conductive substrate 1, and then drying for 60 minutes at a temperature of 120° C.

A coating liquid 7 was prepared by the dissolution and dispersion in 800 mass parts 1,2-dichloroethane of 1.2 mass parts of a metal-free phthalocyanine with the following formula as a charge generation material,

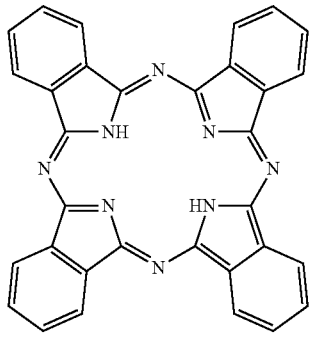

10 mass parts of a stilbene compound with the following formula as a hole transport material,

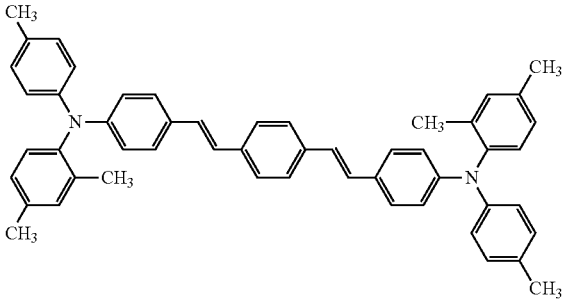

25 mass parts of a compound with the following formula as an electron transport material,

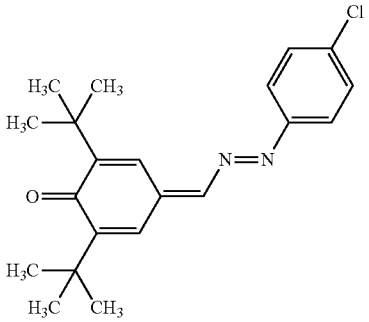

and 60 mass parts of the polyarylate copolymer resin (III-1) of Production Example 1 as the binder resin; this coating liquid 7 was applied by dip coating on the aforementioned charge transport layer 5; and the positive-charge stacked photoreceptor was produced by drying for 60 minutes at a temperature of 100° C. to form a photosensitive layer 3 having a film thickness of 15 μm.

Comparative Example 7

A photoreceptor was produced by the same method as in Example 17, but changing the polyarylate copolymer resin (III-1) of Production Example 1 used in Example 17 to the polyarylate copolymer resin (III-16) of Production Example 16.

Evaluation of the Photoreceptors

The electrical properties of the photoreceptors produced in Examples 1 to 17 and Comparative Examples 1 to 7 were evaluated using the methods described below. The state of the coating fluid was also evaluated based on the solubility in the solvent of the resin binder during preparation of the coating liquid for the charge transport layer.

Electrical Properties

The electrical properties of the photoreceptors obtained in the examples and comparative examples were evaluated by the following method using a process simulator (CYNTHIA 91) from Gentec Co., Ltd. For the photoreceptors of Examples 1 to 17 and Comparative Examples 1 to 7, the surface of the photoreceptor was charged to −650 V by corona discharge in the dark in a 22° C. temperature/50% humidity environment, and the surface potential $V_0$ was then measured immediately after charging. The surface potential $V_5$ was subsequently measured after standing for 5 seconds in the dark, and the potential retention ratio $Vk_5$ (%) at 5 seconds after charging was determined using the following formula (1).

$$Vk_5=V_5/V_0\times100 \quad (1)$$

Then, at the time point when the surface potential had reached −600 V, the photoreceptor was irradiated for 5 seconds from a halogen lamp light source with 1.0 μW/cm$^2$ of exposure light spectrally separated to 780 nm using a filter, and the exposure dose required to photodecay the surface potential to −300 V was evaluated as $E_{1/2}$ (μJ/cm$^2$) and the residual potential of the photoreceptor surface at 5 seconds after exposure was evaluated as $Vr_5$ (V).

Machine Evaluations

Each of the photoreceptors produced in Examples 1 to 14 and Comparative Examples 1 to 5 was installed in an HP LJ4250 printer that had also been modified to enable measurement of the surface potential of the photoreceptor, and the amount of wear (μ) post-printing was evaluated by printing 10,000 sheets of A4 paper and measuring the film thickness of the photoreceptor before and after printing. In addition, each of the photoreceptors produced in Examples 15 to 17 and Comparative Examples 6 and 7 was installed in a Brother HL-2040 printer that had also been modified to enable measurement of the surface potential of the photoreceptor and the exposure unit potential was evaluated. The amount of wear (μ) post-printing was also evaluated by printing 10,000 sheets of A4 paper and measuring the film thickness of the photoreceptor before and after printing.

Molecular Structure Calculations for the Resins

With regard to the structure of the resins produced in the production examples, structure optimization calculations were carried out for the resins based on the charged molar ratios when the constituent monomers were polymerized. The structure optimization calculations were carried out using COGNAC, which is a molecular dynamics simulation program in J-OCTA (JSOL Corporation); the resin structure was formed using an all-atom model; Dreiding Model was selected for the force field parameters; the temperature condition was 300 K; the maximum number of repetitions was 10,000; the convergence criterion value was made 1%; and the optimized three-dimensional molecular structure (stable structure) was provided by RIS Monte Carlo calculations. The number of repeat monomers was made the minimum number of repetitions at which the total number of atoms exceeded 10,000.

When the molecular structure obtained for the polymer assumed a helical structure, the diameter (r) (angstrom) and the helix pitch (I) (angstrom) of the helical structure were determined from the corresponding molecular coordinates and the value of r/I was then calculated. The results of these evaluations are given in the following Tables 2 and 3.

TABLE 2

| Example | Production Example | resin | molecular weight Mw (×10$^4$) | solubility | $Vk_5$ (%) | $E_{1/2}$ (μJ/cm$^2$) | $Vr_5$ (V) | amount of film wear μm | image after printing durability test | resin structure calculation r/I |
|---|---|---|---|---|---|---|---|---|---|---|
| Example 1 | Production Example 1 | (III-1) | 15.0 | soluble | 96.7 | 0.14 | 16 | 1.8 | good | 0.041 |
| Example 2 | Production Example 2 | (III-2) | 15.5 | soluble | 97.1 | 0.13 | 15 | 1.7 | good | 0.070 |
| Example 3 | Production Example 3 | (III-3) | 14.2 | soluble | 97.2 | 0.13 | 14 | 1.5 | good | 0.099 |
| Example 4 | Production Example 4 | (III-4) | 15.2 | soluble | 96.5 | 0.13 | 16 | 1.8 | good | 0.128 |
| Example 5 | Production Example 5 | (III-5) | 14.8 | soluble | 96.7 | 0.13 | 15 | 1.9 | good | 0.151 |
| Example 6 | Production Example 6 | (III-6) | 14.2 | soluble | 96.8 | 0.13 | 14 | 1.8 | good | 0.172 |
| Example 7 | Production Example 7 | (III-7) | 15.1 | soluble | 97.0 | 0.15 | 29 | 1.7 | good | 0.160 |
| Example 8 | Production Example 8 | (III-8) | 14.4 | soluble | 97.1 | 0.14 | 23 | 2.0 | good | 0.264 |
| Example 9 | Production Example 9 | (III-9) | 14.0 | soluble | 96.6 | 0.13 | 20 | 1.7 | good | 0.274 |
| Example 10 | Production Example 10 | (III-10) | 14.2 | soluble | 96.8 | 0.13 | 14 | 1.6 | good | 0.290 |
| Example 11 | Production Example 11 | (III-11) | 15.3 | soluble | 96.4 | 0.13 | 13 | 1.7 | good | 0.189 |
| Example 12 | Production Example 12 | (III-12) | 14.9 | soluble | 96.5 | 0.13 | 12 | 1.6 | good | 0.171 |
| Example 13 | Production Example 13 | (III-13) | 13.8 | soluble | 96.7 | 0.14 | 21 | 1.9 | good | 0.196 |
| Example 14 | Production Example 7 | (III-7) | 15.1 | soluble | 96.6 | 0.13 | 14 | 1.8 | good | 0.160 |
| Comp. Example 1 | Production Example 14 | (III-14) | 14.0 | soluble | 97.0 | 0.15 | 28 | 3.0 | streak defects are present | 0.009 |
| Comp. Example 2 | Production Example 15 | (III-15) | 14.4 | soluble | 96.3 | 0.13 | 25 | 2.8 | streak defects are present | nonhelical structure |
| Comp. Example 3 | — | (III-18) | 6.3 | soluble | 96.5 | 0.18 | 19 | 6.0 | streak defects are present | nonhelical structure |
| Comp. Example 4 | Production Example 16 | (III-16) | 14.0 | soluble | 96.5 | 0.16 | 29 | 2.5 | streak defects are present | 0.015 |

TABLE 2-continued

| Example | Production Example | resin | molecular weight Mw ($\times 10^4$) | solubility | $Vk_5$ (%) | $E_{1/2}$ ($\mu J/cm^2$) | $Vr_5$ (V) | amount of film wear μm | image after printing durability test | resin structure calculation r/l |
|---|---|---|---|---|---|---|---|---|---|---|
| Comp. Example 5 | Production Example 17 | (III-17) | could not be measured | insoluble | — | — | — | — | — | nonhelical structure |

TABLE 3

| Example | Production Example | resin | molecular weight Mw ($\times 10^4$) | solubility | $Vk_5$ (%) | $E_{1/2}$ ($\mu J/cm^2$) | $Vr_5$ (V) | amount of film wear μm | image after printing durability test | resin structure calculation r/l |
|---|---|---|---|---|---|---|---|---|---|---|
| Example 15 | Production Example 1 | (III-1) | 15.0 | soluble | 88.8 | 0.75 | 44 | 2.7 | good | 0.041 |
| Example 16 | Production Example 1 | (III-1) | 15.0 | soluble | 87.2 | 0.69 | 35 | 2.8 | good | 0.041 |
| Comp. Example 6 | Production Example 16 | (III-16) | 14.0 | soluble | 87.9 | 0.77 | 46 | 4.8 | streak defects are present | 0.015 |
| Example 17 | Production Example 1 | (III-1) | 15.0 | soluble | 87.2 | 0.61 | 29 | 2.0 | good | 0.041 |
| Comp. Example 7 | Production Example 16 | (III-16) | 14.0 | soluble | 87.9 | 0.64 | 31 | 3.5 | streak defects are present | 0.015 |

According to the results in the preceding tables, low values were obtained in Examples 1 to 17 for the amount of film wear after a printing durability test in an actual machine, and were obtained without impairing the electrical properties in the role as a photoreceptor. In Comparative Examples 1 to 4, 6, and 7, on the other hand, a large amount of film wear was observed and streak image defects were seen in the image after the printing durability test. The evaluations could not be carried out in Comparative Example 5 due to an inadequate solubility by the resin. In Examples 1 to 14, the r/I value for the structure calculated based on the monomer ratio in resin synthesis exhibits numerical values from 0.04 to 1.0 and it is thus shown that the wear resistance is improved by the intertwining effect of the resin structure. The printing durability was unsatisfactory in Comparative Example 4, which used resin (III-16) which had a molar ratio (a+b):(c+d) (M7:BP)=60:40, while a photoreceptor could not be produced due to a lack of solubility in Comparative Example 5, which used resin (III-17) which had a molar ratio (a+b):(c+d) (M7:BP)=50:50.

It was thus confirmed in accordance with the preceding that the use of the helically structured resin according to the present invention can provide an excellent electrophotographic photoreceptor that undergoes little wear while not suffering from a loss in electrical properties.

EXPLANATION OF REFERENCE NUMERALS

1 conductive substrate
2 undercoat layer
3 monolayer photosensitive layer
4 charge generation layer
5 charge transport layer
7 photoreceptor
21 roller charging member
22 high-voltage power source
23 imagewise exposure member
24 developing device
241 developing roller
25 paper feed member
251 paper feed roller
252 paper feed guide
26 transfer charging device (direct charging type)
27 cleaning apparatus
271 cleaning blade
28 neutralization member
60 electrophotographic apparatus
300 photosensitive layer

What is claimed is:

1. An electrophotographic photoreceptor, comprising:

a conductive substrate; and a photosensitive layer provided on the conductive substrate and being comprised of a polyarylate resin that has a molecular structure optimized using molecular dynamic calculations that is a helical structure, and that has a value for a ratio r/I between the diameter (r) and helix pitch (I) of the helical structure that ranges from 0.04 to 1.0, wherein the polyarylate resin has repeat units represented by a chemical structural formula 1 as follows:

(A)

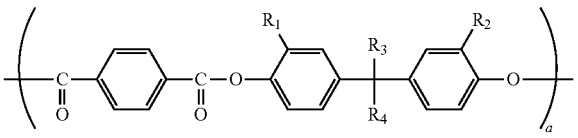

-continued (B)

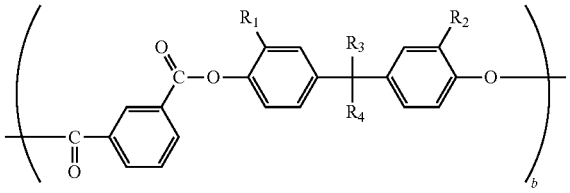

(C)

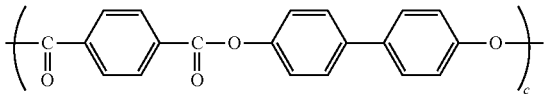

(D)

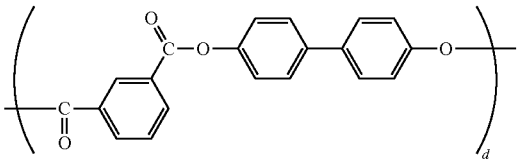

where substructure formulas (A), (B), (C), and (D) each represent a structural unit that constitutes the resin; a, b, c, and d respectively represent mol % of the structural units (A), (B), (C), and (D); a+b+c+d is 100 mol %; $R_1$ and $R_2$ may be the same or different and represent a $C_{2-8}$ alkyl group, a possibly substituted cycloalkyl group, or a possibly substituted aryl group; and $R_3$ and $R_4$ may be the same or different and represent a hydrogen atom, a $C_{1-8}$ alkyl group, a possibly substituted cycloalkyl group, or a possibly substituted aryl group, or $R_3$ and $R_4$ may form a cyclic structure together with the carbon atom to which $R_3$ and $R_4$ may are bonded, and 1 or 2 arylene groups may be bonded to this cyclic structure.

2. The electrophotographic photoreceptor according to claim 1, wherein the c and d in the chemical structural formula 1 are 0 mol %.

3. The electrophotographic photoreceptor according to claim 1, wherein the b in the chemical structural formula 1 is a mol % that ranges from 65 mol % to less than 100 mol %.

4. The electrophotographic photoreceptor according to claim 1, wherein the photosensitive layer is comprised of at least a charge generation layer and a charge transport layer, and the charge transport layer contains the resin and a charge transport material.

5. The electrophotographic photoreceptor according to claim 4, wherein the charge generation layer and the charge transport layer are stacked in this sequence over the conductive substrate.

6. The electrophotographic photoreceptor according to claim 1, wherein the photosensitive layer contains the resin, a charge generation material, and a charge transport material.

7. The electrophotographic photoreceptor according to claim 6, wherein the charge transport material contains a hole transport material and an electron transport material.

8. The electrophotographic photoreceptor according to claim 1, wherein the photosensitive layer is comprised of at least a charge transport layer and a charge generation layer, and the charge generation layer contains the resin, a charge generation material, and a charge transport material.

9. The electrophotographic photoreceptor according to claim 8, wherein the charge transport layer and the charge generation layer are stacked in this sequence over the conductive substrate.

10. An electrophotographic apparatus, comprising the electrophotographic photoreceptor according to claim 1.

11. A method of producing an electrophotographic photoreceptor, comprising:

providing a conductive substrate;

providing a coating liquid that contains at least a resin binder comprised of a a polyarylate resin that has a molecular structure optimized using molecular dynamic calculations that is a helical structure, and that has a value for a ratio r/I between the diameter (r) and helix pitch (I) of the helical structure that ranges from 0.04 to 1.0; and forming a photosensitive layer on the conductive substrate by coating the coating liquid thereon, wherein the polyarylate resin has repeat units represented by the following chemical structural formula 1:

(A)

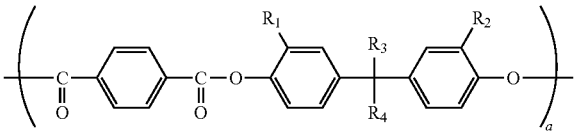

(B)

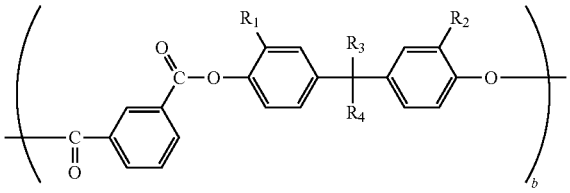

(C)

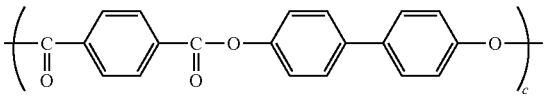

(D)

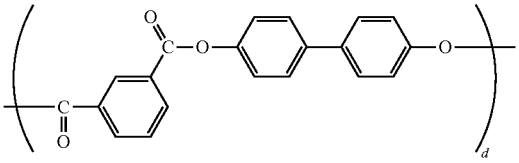

where substructure formulas (A), (B), (C), and (D) each represent a structural unit that constitutes the resin; a, b, c, and d respectively represent mol % of the structural units (A), (B), (C), and (D); a+b+c+d is 100 mol %; $R_1$ and $R_2$ may be the same or different and represent a $C_{2-8}$ alkyl group, a possibly substituted cycloalkyl group, or a possibly substituted aryl group; and $R_3$ and $R_4$ may be the same or different and represent a hydrogen atom, a $C_{1-8}$ alkyl group, a possibly substituted cycloalkyl group, or a possibly substituted aryl group, or $R_3$ and $R_4$ may form a cyclic structure together with the carbon atom to which $R_3$ and $R_4$ are bonded, and 1 or 2 arylene groups may be bonded to this cyclic structure).

* * * * *